United States Patent [19]

Takehara et al.

[11] Patent Number: 5,068,173

[45] Date of Patent: Nov. 26, 1991

[54] PHOTOSENSITIVE SILVER HALIDE EMULSIONS CONTAINING PARALLEL MULTIPLE TWIN SILVER HALIDE GRAINS AND PHOTOGRAPHIC MATERIALS CONTAINING THE SAME

[75] Inventors: Hiroshi Takehara; Hideo Ikeda, both of Kanagawa, Japan

[73] Assignee: Fumi Photo Film Co., Ltd., Kanagawa, Japan

[21] Appl. No.: 307,711

[22] Filed: Feb. 8, 1989

[30] Foreign Application Priority Data

Feb. 8, 1988 [JP] Japan ..... 63-26977

[51] Int. Cl.[5] ..... G03C 1/035

[52] U.S. Cl. ..... 430/567; 430/569

[58] Field of Search ..... 430/567, 569

[56] References Cited

U.S. PATENT DOCUMENTS

| | | | |
|---|---|---|---|
| 4,614,711 | 9/1986 | Sugimoto et al. | 430/569 |
| 4,713,318 | 12/1987 | Sugimoto et al. | 430/569 |
| 4,853,322 | 8/1989 | Makino et al. | 430/567 |

FOREIGN PATENT DOCUMENTS

| | | | |
|---|---|---|---|
| 0273411 | 7/1988 | European Pat. Off. | 430/567 |
| 0282896 | 9/1988 | European Pat. Off. | 430/567 |

OTHER PUBLICATIONS

Theory of the Photographic Process, T. H. James, ed., 4th edition, p. 20, Macmillan Publishing, 1977.

Convergent-Beam X-Ray Analysis of Mosaic Structure in Polycrystals, C. R. Berry, Journal of Applied Physics, vol. 27, No. 6, p. 636, 1956.

*Primary Examiner*—Charles L. Bowers, Jr.
*Assistant Examiner*—Janet C. Baxter
*Attorney, Agent, or Firm*—Sughrue, Mion, Zinn, Macpeak & Seas

[57] ABSTRACT

Photosensitive silver halide emulsions are disclosed which comprise photosensitives silver halide grains dispersed in a binder, wherein at least 70% of the total projected area of the silver halide grains is accounted for by tabular grains of a diameter of at least 0.15 μm, wherein the mean aspect ratio of the tabular grains is not more than 8.0, wherein grains in which the value of the ratio (b/a) of the longest distance (a) between two or more parallel twinning planes in the tabular grain and the grain thickness (b) is at least 5 account for at least 50% (in terms of numbers of grains) of all of the tabular grains, and wherein at least 50% (in terms of the numbers of grains) of the tabular grains are grains in which the number of dislocations per grain is at least 10.

12 Claims, No Drawings

PHOTOSENSITIVE SILVER HALIDE EMULSIONS CONTAINING PARALLEL MULTIPLE TWIN SILVER HALIDE GRAINS AND PHOTOGRAPHIC MATERIALS CONTAINING THE SAME

FIELD OF THE INVENTION

This invention concerns photosensitive silver halide emulsions which contain parallel multiple twin silver halide grains, which emulsions have high sensitivity and improved graininess, and it concerns silver halide color photographic materials for camera use which have improved sharpness and graininess.

BACKGROUND OF THE INVENTION

Progress has been made with higher sensitivity and smaller format silver halide color negative films in recent years, and there is a demand for color negative photographic materials which have high sensitivities and provide excellent image quality.

Thus, the requirements of silver halide emulsions for photographic purposes have become more rigorous and a demand has arisen for a higher level of photographic performance in terms of high sensitivity, high contrast, superior graininess and sharpness, etc.

Techniques involving the use of tabular grains intended to provide an increase in sensitivity, including an increase in color sensitizing efficiency with sensitizing dyes, to improve of the relationship between sensitivity and graininess, to improve sharpness, and to increase covering power have been disclosed in response to these demands in U.S. Pat. Nos. 4,434,226, 4,414,310, 4,433,048, 4,414,306 and 4,459,353.

Furthermore, multi-layer color photographic materials which have a high sensitivity and improved graininess, sharpness and color reproduction in which tabular silver halide emulsions in which the grains have an aspect ratio of at least 8 : 1 are used in the high sensitive layers have been disclosed in JP-A-58-113930, JP-A-58-113934 and JP-A-59-119350. (The term "JP-A" as used herein means an "unexamined published Japanese patent application".)

According to these patents, tabular grains improve sharpness when they are used in the blue sensitive layer because of their low scattering properties, and it has also been noted that graniness is improved when tabular grains are used in the green or red sensitive layers.

Moreover, multi-layer color photographic materials in which tabular silver halide emulsions in which the grains have an aspect ratio of at least 5 : 1 are used in the high sensitive layers and monodisperse silver halide emulsions are used in the low sensitive layers, and which have improved sharpness and color reproduction, have been disclosed in JP-A-61-77847.

Furthermore, methods in which the reflection of light which photosensitizes the emulsion in the layer above a layer in which tabular grains are being used is increased, and the sensitivity of the upper layer is increased by adjusting the thickness of the tabular grains, and in which reflection is minimized and there is no loss of sharpness of the upper layer, have been disclosed in Research Disclosure No. 25330.

Thus, tabular grains which have a high aspect ratio provide various advantages, but in the so-called sequential layer structure (a layer structure consisting sequentially starting furthest away from the support of blue sensitive layers, green sensitive layers and red sensitive layers of different sensitivities) which is most often used in color photographic materials, there is a problem in that the sharpness on the low frequency side deteriorates when tabular grains which have a high aspect ratio (for example an aspect ratio of 8 or above) are used in layers other than the photosensitive layer which is furthest from the support, and especially in the green or red sensitive layer.

Silver halide color photographic materials in which there is at least one blue sensitive layer which contains tabular silver halide grains of which the mean aspect ratio is at least 5, and in which substantially monodisperse, non-tabular silver halide grains of which the aspect ratio is not more than 5 are included in at least one of the green sensitive emulsion and red sensitive emulsion layers, have been proposed in Japanese Patent Application No. 61-235763 (corresponding to JP-A63-89839) as a means of ameliorating this deterioration of the sharpness of the green and red sensitive layers.

In this case, the use of regular crystals, such as tetradecahedral grains, is especially desirable for the monodisperse grains of which the mean aspect ratio is not more than 5. However, silver halide emulsions of which the distinguishing features are that, for the preferred grains, at least 70% of the total projected area of the silver halide grains is provided by tabular grains having a diameter of at least 15 μm, that the aspect ratio of the said tabular grains is not more than 8.0, and that grains of which the ratio (b/a) of the longest distance (a) between two or more of the parallel twinning planes of the said tabular grains and the thickness of the grain (b) has a value of at last 5 account for at least 50% (by number) of all the tabular grains, and the use of the silver halide emulsions in at least one silver halide emulsio layer other than a silver halide emulsion layer which is located furthest from a support have been disclosed in Japanese Patent Application No. 61-311130 (corresponding to EP-A-0273411). According to Japanese Patent Application No. 61-311130, silver halide emulsions of which the sensitivity with respect to the average size is high when compared to regular crystals and with which there is no deterioration of graininess with respect to the average size are obtained by making the iodine distribution, the thickness (b) of the grains and the b/a distribution, and the grain size distribution uniform between the tabular grains, which are multiple parallel twin silver halide grains which have re-entrant angles which it has long been suggested form sites which can easily form chemical sensitization nuclei. Furthermore, although there is a problem in that the sharpness on the low frequency side deteriorates when a silver halide emulsion containing grains having the aspect ratio of 8 or above is used in a silver halide emulsion layer other than a silver halide emulsion layer located furthest from a support, when the silver halide emulsion as described in Japanese Patent Application No. 61-311130 is used, there is not the problem.

However, as a result of further investigation it has been discovered that these are unsuitable since pronounced fogging occurs when a pressure is applied to a silver halide photographic material which contains the said grains. Furthermore, a higher level is also required in respect of exposure luminance dependence (which is connected with sensitivity) and storage properties, etc., and the materials were still unsatisfactory from this point of view.

Techniques for improving pressure characteristics by establishing phases which have different average iodide contents within the silver halide have been disclosed in JP-A-59-99433 and JP-A-60-147727, but it has not been possible to achieve satisfactory pressure characteristics for practical purposes in this way.

A technique for improving pressure characteristics, and exposure luminance dependence and storage properties, by the controlled introduction of dislocations during the formation of the grains has been disclosed in Japanese Patent Application No. 62-54640 (corresponding to EP-A-0282896). However, although examples of tabular grains of which the aspect ratio is at least 2 are disclosed in the said patent there is no disclosure concerning the ratio b/a.

The inventors have therefore attempted to develop emulsions which have an excellent sensitivity/graininess ratio, and which also have excellent pressure characteristics, exposure luminance dependence and storage properties, by the controlled introduction of dislocations into tabular grains of aspect ratio not more than 8.0 of which the size distribution is uniform, of which the iodide distribution is uniform between the grains, and of which the longest distance (a) between two or more parallel twinning planes, the grain thickness (b), and the ratio b/a, are uniform. Further, the inventors have atempted to develop photographic materials which have excellent sensitivity/graininess ratio, sharpness, pressure characteristics, exposure luminance dependence and storage properties, by using the emulsion in a silver halide emulsion layer other than a silver halide emulsion layer which is located furthest from a support.

SUMMARY OF THE INVENTION

The aim of this invention is firstly to provide photosensitive silver halide emulsions consisting of twin silver halide grains which have parallel twining planes which have high sensitivity, excellent graininess, improved pressure characteristics, exposure luminance dependence and storage properties, and secondly to improve the sharpness of the green and red sensitive layers and to improve the graininess of both layers.

As a result of thorough research carried out by the inventors in connection with the relationship between the structure of tabular grains and photographic performance as indicated earlier, it is been discovered that the first aim of the invention can be realized by means of the silver halide emulsions indicated below.

That is, the first aim of the invention is realized by photosensitive silver halide emulsions of which the distinguishing features are that, in a photosensitive silver halide emulsion consisting of photosensitive silver halide grains contained in a binder, at least 70% of the total projected area of the said silver halide grains is accounted for by tabular grains of diameter at least 0.15 μm, that the mean aspect ratio of the said tabular grains is not more than 8.0, that grains in which the value of ratio (b/a) of the longest distance (a) between two or more parallel twinning planes in the said tabular grain and the grain thickness (b) is at least 5 account for at least 50% (in terms of numbers of grains) of all of the tabular grains, and that at least 50% (in terms of the numbers of grains) of the said tabular grains are grains in which the number of dislocations per grain is at least 10.

The second aim of the invention is realized by a color photosensitive material comprising at least one blue sensitive silver halide emulsion layer, at least one green sensitive silver halide emulsion layer, and at least one red sensitive silver halide emulsion layer, provided on a support, wherein a photosensitive silver halide emulsion wherein at least 70% of the total projected area of silver halide grains is accounted for by tabular grains having a diameter of at least 0.15 μm, wherein the mean aspect ratio of said tabular grains is not more than 8.0, wherein grains in which the value of the ratio (b/a) of the longest distance (a) between two or more parallel twinning planes in the tabular grain and the grain thickness (b) is at least 5 account for at least 50% (in terms of numbers of grains) of all of said tabular grains, and wherein at least 50% (in terms of the numbers of grains) of said tabular grains are grains in which the number of dislocations per grain is at least 10 is included in at least one silver halide emulsion layer other than a silver halide emulsion layer which is located furthest from the support.

DETAILED DESCRIPTION OF THE INVENTION

Here, the term "tabular grain" is a general term for grains in which a twining plane has at least two parallel twining planes. The term "twining plane" signifies that if the twining plane is the (1,1,1) plane, all the ions at the lattice points on either side of the (1,1,1) plane in this case have a mirror image relationship.

When seen from above, tabular grains may have a triangular form, a hexagonal form, or a circular form in which these forms have been rounded off, and they have parallel external surfaces which are triangular in the case of grains which have a triangular form, hexagonal in the case of grains which have a hexagonal form, and circular in the case of grains which have a circular form.

Here, the grain thickness (b) is the distance between these parallel external surfaces, and the measurement of the grain thickness is carried out easily by vapor depositing a metal from an oblique angle onto the grains and latex particles of known size for comparison, measuring the lengths of the shadows on an electron micrograph, and then calculating the thickness with reference to the length of the shadow obtained with the latex particles. The latex for comparison is described, for example, in U.S. Pat. No. 4,434,226 and European Patent 0 273 411A2.

The grain diameter in this invention is the diameter of a circle which has an area equal to the projected area of the parallel outer surfaces of the grain.

The projected area of a grain is obtained by measuring the areas on an electron micrograph and making a correction for the projection factor, as described in European Patent 0 273 411A2.

The "mean aspect ratio" of the tabular grains in this invention is the average value of the values obtained by dividing the diameter of each tabular grain which has a u diameter of at least 0.15 μm by its thickness (b).

The formula used for measuring the distance (a) between the twining planes in this invention is described below.

The twining plane distance (a) is the distance between the two twining planes measured perpendicularly to the twinning plane in a grain which has two twining planes within the grain, and it is the longest distance among the distances between the twining planes in grains which have three or more twining planes.

Twining planes can be observed by means of a transmission type electron microscope.

In practical terms, a sample in which tabular grains are orientated more or less parallel to the support is prepared by coating an emulsion consisting of tabular grains on a support and this is then prepared as a slice of thickness about 0.1 μm by cutting with a diamond knife in the direction of 90% to the coated surface.

The twinning planes in the tabular grains can then be found by observing this slice with a transmission type electron microscope.

When the electron beam passes through a twinning plane it produces a deviation in the phase of the electron wave and so its presence can be detected.

The distance between the twinning planes is obtained by measuring the distances on an electron micrograph and making a correction for the projected factor.

The distance between the twining planes of a tabular grain can be estimated with reference to the method indicated by J. F. Hamilton and L. F. Brady et al. in J. Phys., 35, 414–421 (1964), but the method indicated above is easier.

The number of dislocations can be defined as follows. That is, when the dislocations observed in case where a grain is seen from the direction perpendicular to the grain surface finally reach to the outermost periphery of the grain, the number of the end points on the outermost periphery is the number of dislocations of the grain.

In this invention, tabular grains of which the diameter is 0.15 μm or above preferably account for at least 80%, and most desirably at least 90%, of the total projected area of the silver halide grains.

The diameter of the tabular grains is from 0.15 to 5.0 μm, preferably from 0.20 to 2.0 μm, and most desirably from 0.25 to 1.2 μm.

The thickness of the tabular grains is from 0.05 to 1.0 μm, preferably from 0.1 to 0.5 μm, and most desirably from 0.1 to 0.3 μm.

In this invention, tabular grains of which the value of (b/a) is at least 5 account for at least 50%, preferably at least 70%, and more desirably at least 90%, of the total number of tabular grains. Most desirably, tabular grains of which the value of (b/a) is at least 10 account for at least 50%, preferably at least 70%, and more desirably at least 90%, of the total number of tabular grains.

Moreover, the coefficient of variation of the grain thickness (b) is preferably not more than 20%, the coefficient of variation of the value of (b/a) is preferably not more than 20%, and the coefficient of variation of the projected area of the tabular grains is preferably not more than 30%.

The coefficient of variation of the thickness (b) is 100 times the value obtained by dividing the standard deviation for the thickness (b) by the average value of the thickness (b). The coefficients of variation for (b/a) and the projected area are similarly defined.

Any of the silver halides, which is to say silver bromide, silver iodobromide, silver iodochloride, silver chlorobromide and silver chloride, can be used in the photographic emulsions of this invention.

The photographic emulsions of this invention may be such that there are at least two layers which have substantially different halogen compositions within the silver halide grains, or the grains may have a uniform composition.

The emulsions in which the grains have a two layer structure with layers of different halogen compositions may be emulsions in which a layer of high iodide content is present in the core part and a layer which has a low iodide content is present as the outermost layer, or of the type in which a layer of low iodide content is present in the core part and a layer which has a high iodide content is present as the outermost layer. Moreover, the layer structure may consist of three or more layers, and those in which a layer of low iodide content is located on the outside are preferred.

The mean aspect ratio of the silver halide emulsions of this invention is not more than 8.0, preferably not more than 5.0 and, most desirably, it within the range from 2.0 to 5.0.

An emulsion of this invention can be prepared using the method of precipitation and formation indicated below. Thus a dispersion medium is introduced into a reactor of the type normally used for the precipitation and formation of silver halides which has been furnished with an agitator. Normally, the amount of dispersion medium introduced into the reactor prior to the addition of the silver salt is at least about 10%, and preferably from 20% to 80%, of the amount of dispersion medium present in the silver iodobromide emulsion after the grain precipitttion and formation. Water, or a dispersion in water of a deflocculating agent, is used for the dispersion medium which is initially introduced into the reactor, and other components, for example one or more silver halide ripening agents and/or metal dopants as described hereinafter, may be compounded in the dispersion medium. When a deflocculating agent is present initially, its concentration is preferably at least 10%, and most desirably at least 20%, of the total amount of deflocculating agent which will be present in the final stages of silver iodobromide precipitation and formation. The amount of deflocculating agent which is present in the final stages of silver iodobromide precipitation and formation is from 1 to 50% of the total weight of emulsion which is present in the final stage in the reactor. Additional dispersion medium can be added to the reactor along with silver and halide salts, but it can introduced from a separate jet. In general, the proportion of dispersion medium is adjusted after completion of the introduction of the halide salt in order to increase the proportion of the deflocculating agent in particular.

Generally, less than 10 wt% of the bromide salt which is used to form the silver iodobromide is present in the reactor prior to the precipitation of silver iodobromide, and the bromide ion concentration in the dispersion medium is adjusted at the commencement of the precipitation and formation of the silver iodobromide. Furthermore, the dispersion medium in the reactor is substantially iodide ion free prior to the precipition of silver iodobromide. This is because thick, non-tabular grains are liable to be formed if iodide ions are present prior to the initial addition of the silver and the bromide salt, and even if tabular grains are formed the distance between the twinning planes will be inappropriate when observed using the method of observation described hereinafter, and the distribution of (b/a) will be widened. Here, the term "substantially iodide free" signifies that, relative to the bromide ion, the iodide ion is present only in such an amount which is adequate for the formation of a silver iodobromide phase but inadequate for the precipitation of a separate silver iodide phase. The iodide concentration in the reactor prior to the introduction of the silver salt is preferably maintained at less than 0.5 mol.% of the total halide ion concentration in the reactor. If the pBr value of the dispersion medium is too high initially, then the tabular silver iodobromide grains which form will be comparatively thick, and the distribution of grain thickness and the distribution of the (b/a) values will be widened. Furthermore, there will be an increase in the number of non-tabular grains. If, on the other hand, the pBr value is too low, then once again non-tabular grains are liable to be formed. As a result of investigations in which the twinning plane distance of tabular silver iodobromide grains was observed, it has been discovered that narrow thickness and (b/a) value distributions are obtained by maintaining the pBr value in the reactor at 0.6 or above but less than 2.0, and preferably at 1.1 or above but less than 1.8 at the initial stage. The pBr value used here is defined as the negative value of the logarithm of the bromide ion concentration.

Silver, bromide and iodide salts are added to the reactor in accordance with the known methods for the precipitation and formation of silver iodobromide grains. Normally, an aqueous solution of a soluble silver salt such as silver nitrate is introduced into the reactor at the same time as the introduction of the bromide and iodide salts. Furthermore, the bromide and iodide salts are introduced as aqueous salt solutions such as aqueous solutions of a soluble ammonium, alkali metal (for example sodium or potassium) or alkaline earth metal (for example magnesium or calcium) halide. The silver salt is introduced into the reactor separately from the bromide salt and the iodide salt, at least initially. The bromide salt and the iodide salt may be added separately or they may be added in the form of, a mixture.

Grain nucleation starts when the silver salt is introduced into the reactor. As the introduction of silver, bromide and iodide salts is continued a number of nuclei which play the role of sites for the precipitation and formation of silver bromide and silver iodide are formed. The grains then enter the growth stage with the precipitation and formation of silver bromide and silver iodide on the nuclei which are present. The average value of the diameter of a circle corresponding in area to the projected area of the tabular silver halide grains prior to entering the grain growth stage is preferably not more than 0.6 μm and most desirably not more than 0.4 μm. The nucleation conditions can be established with reference to the method disclosed in Japanese Patent Application No. 61-48950 (corresponding to JP-A-63-11928 and DE-A3707135), but the present invention is not limited to this method and, for example, nucleation temperatures within the range from 5° C. to 55° C. can be used.

The size distribution of the tabular grains formed in accordance with this present invention is greatly affected by the concentration of the bromide salt and the iodide salt during the growth stage subsequent ot the initial stage. If the pBr value is too low then tabular grains which have a high aspect ratio are formed and the coefficient of variation of their projected area is very large. It is possible to form tabular grains of which the coefficient of variation of the projected area is small by maintaining the pBr value between about 2.2 and 5, and preferably between 2.5 and 4 during the growth stage.

The same concentrations and rates of introduction of the silver, bromide and iodide salts as used conventionally can be used for satisfying the pBr conditions outlined above. The silver and halide salts are preferably introduced at a concentration of from 0.1 to 5 mol per liter, but the wide concentration ranges normally used in the past ranging, for example, from 0.01 mol per liter to saturation, can be used. The methods of precipitation and formation in which the rates at which the silver and halide salts are introduced are increased and the precipitation and formation time is shortened are especially desirable for practical reasons. The rate at which the silver and halide salts are introduced can be increased by increasing the rates at which the dispersion medium and the silver and halide salts are introduced, or by increasing the concentration of the silver and halide salts in the dispersion medium which is being introduced. It is possible to reduce the coefficient of variation of the projected area of the grains further by maintaining the rate of addition of the silver and halide salts close to the critical value at which the formation of new grain nuclei are formed, as disclosed in JP-A-55-142329. The temperature for grain growth within the range of from 5° C. to 85° C. can be used.

Attention must be given to the facts indicated below as well as the selection of the pBr value and the temperature for nucleation and for the grain growth stage as described above in order to obtain a uniform value for (b/a).

The amount of gelatin in the reactor during nucleation has a great effect on the grain size distribution. If the amount of gelatin is not selected optimally, irregularities occur during nucleation and there is a large variation in the values of (b/a) for the grains when the twinning planes are observed using the method described earlier. A gelatin concentration based on water of from 0.5 to 10 wt.%, and most desirably of from 0.5 to 6 wt.%, is preferred.

The grain size distribution and the distribution of (b/a) is also affected by the rate of agitation and the shape of the reactor.

Apparatus in which the reaction liquids are added and mixed as disclosed in U.S. Pat. No. 3,785,777 is preferred for the agitating and mixing apparatus, and the rate of agitation should be neither too high nor too low. The proportion of non-parallel twin silver halide grains which are formed increases if the rate of agitation is too low, and the frequency of tabular grains which are formed decreases the grain size distribution is also widened if the rate of agitation is too high.

The use of a reactor of which the base has a hemispherical shape is most desirable.

The dislocations in tabular grains can be observed using the direct method in which a transmission type electron microscope is used at low temperature as described, for example, by J.F. Hamilton in Phot. Sci. Eng., 11, 57 (1967) and by T. Shiozawa in J. Soc. Phot. Sci. Japan, 35, 213 (1972). That is to say, silver halide grains which have been removed carefully from an emulsion in such a way that no pressure of an extent which could produce dislocations in the grains has been imposed on them are located on a mesh as used for electron microscopic observation, and observations are made using the transmission method in a state in which the sample has been cooled so as to prevent any damage (printout, etc.) from being done by the electron beam. At this time, the observations can be made more precisely by using a high voltage type electron microscope (at last 200 kV for a grain of thickness 0.25 μm) since it becomes more difficult for the electron beam to penetrate as the grains become thicker. The positions and numbers of dislocations in each grain when seen in a direction perpendicular to the principal parallel planes can be obtained from photographs of the grains which have been obtained using this method.

The location at which the dislocations of the tabular grains of this invention are formed, in the direction of the long axis of the tabular grains, is from a distance of x% of the length from the center to the edge up to the edge, and the value of x is preferably such that $10 \leqq x < 100$, more desirably such that $30 \leqq x < 98$, and most desirably such that $50 \leqq x < 95$. The shape obtained on joining the positions at which the dislocations start at this time is similar to the shape of the grain, but it is displaced and not of a perfectly corresponding shape. The orientation of the dislocation lines is roughly from the center to the edge, but they often have a meandering form.

The number of the tabular grains of this invention which contain at least 10 dislocations is at least 50% (in terms of the number of grains) of the tabular grains. The number of grains which contain at least 10 dislocations is preferably at least 80% (by number) of the grains, and, most desirably, the number of grains which contain at least 20 dislocations is at least 80% (by number) of the grains.

The nature of the halogen composition of the tabular grains can be confirmed using a combination of X-ray diffraction, EPMA (also known as XMA, a method in which a silver halide grain is scanned with an electron beam and the silver halide composition is detected) and ESCA (also known as XPS, a method in which the photoelectrons emitted from the surface of a grain which is being irradiated with X-rays are analyzed), etc.

The term "grain surface" in this invention signifies a region of depth up to about 50 from the surface. The halide composition in this region can be measured using the ordinary ESCA method. The term "interior of the grain" signifies the region other than the surface region mentioned above.

The dislocations in the tabular grains of this invention can be controlled by establishing a specified high iodide phase within the grains. In practical terms, substrate grains are prepared which form the core, regions of a high iodide phase is established on this core using method (1) or method (2) as indicated below, and the finished grains are obtained by covering the core with the high iodide phase with a phase which has a lower iodide content than the high iodide phase.

The iodide content of the substrate tabular grains is lower than that of the high iodide phase, being preferably from 0 to 12 mol. %, and most desirably from 0 to 10 mol. %.

The internal high iodide phase is a silver halide solid solution which contains iodide. In this case, the silver halide is preferably silver iodide, silver iodobromide or silver chloroiodobromide, but silver iodide or silver iodobromide (iodide content from 10 to 40 mol. %) are more desirable, and silver iodide is the most desirable.

It is important that the internal high iodide phase is not deposited uniformly on the surface of the substrate tabular grains but is present in localized areas. Such a localization may be on the principal surfaces of the tabular grain, on a side surface, on an edge, or on the corners. Moreover, it may be selectively coordinated epitaxially to these locations.

(1) The so-called conversion method described, for example, by E. Klein, E. Moisar and G. Miirch in Phot. Korr., 102 (4), 59–63 (1966) can be used for this purpose. In this method, halogen ions of which the solubility of the salt which is formed with silver ion is lower than that of the halogen ion which forms the grains (or the surface region of the grains) at that point in time is added during grain formation, but in this invention it is desirable that the halogen ion which has a lower solubility which is added should be added in an amount greater than a certain value (in relation to the halogen composition) with respect to the surface area of the grains at that point in time. For example, the addition during the formation of the grains of an amount of KI above a certain amount with respect to the surface area of the AgBr grains (at least $8.2 \times 10^{-5}$ mol/m$^2$ of surface area of AgBr) is preferred.

(2) The epitaxial junction method as disclosed, for example, in JP-A-59-133540, JP-A-58-108526 and JP-A-59-162540, can also be used for this purpose. Local control substances for epitaxial growth, such as adsorbable spectrally sensitizing dyes, can be used in this method. An internal high iodide phases of this invention can be formed by adding these substances, or by selecting the conditions for grain growth (for example pAg, pH, temperature, etc.), and adding a silver salt and a halide solution which contains iodide.

When using these two methods it is desirable that the solubility of the silver halide should be very low. This is because the solubility of the system has an effect on the distribution of the high iodide phase on the surface (which is to say that a higher solubility tends to lead to a more uniform surface).

Furthermore, the pAg value of the mixed system is preferably in the range from 6.4 to 10.5, and most desirably in the range from 7.1 to 10.2, when forming the internal high iodide layer.

The outer phase which covers the high iodide layer has a lower iodide content than the high iodide layer, and the iodide content of this layer is preferably from 0 to 12 mol. %, more desirably from 0 to 10 mol. %, and most desirably from 0 to 3 mol. %. The internal high iodide phase, in connection with the long axis orientation of the tabular grain, preferably accounts for from 5 to 80 mol. % of the total silver content of the grain, more desirably it accounts for from 10 to 70 mol. %, and most desirably from 20 to 60.

Here, the term "long axis orientation of the grain" signifies the longer diameter of the tabular grain and the term "short axis orientation" signifies the thickness direction of the tabular grain.

The iodide content of the internal high iodide phase is higher than the average iodide content of the silver bromide, silver iodobromide or silver chloroiodobromide which is present at the grain surface, and it is preferably at least 5 times, and most desirably at least 20 times, this average iodide content.

Moreover, the amount of silver halide which forms the internal high iodide phase is, in terms of the amount of silver, not more than 50 mol. % of the whole grain, and it is preferably not more than 10% and, most desirably, not more than 5 mol. %.

The silver halide photographic materials of this invention have a multi-layer structure obtained by the lamination of emulsion layers which contain binders and silver halide grains for recording the blue, green and red colors separately, and each emulsion layer consists of at least two layers, namely a high sensitive layer and a low sensitive layer. Especially useful layer structures are indicated below.

(1) BH/BL/GH/GL/RH/RL/S (2) BH/BM/BL/GH/GM/GL/RH/RM/RL/S (3) BH/BL/GH/RH/GL/RL/S, as disclosed in U.S. Pat. No. 4,184,876

(4) BH/GH/RH/BL/GL/RL/S, as disclosed in RD-22534, JP-A-59-177551 AND JP-A-59-177552.

Here, B signifies a blue sensitive layer, G signifies a green sensitive layer, R signifies a red sensitive layer, and H signifies the highest sensitive layer, M signifies a medium sensitive layer and L signifies a low sensitive layer, while S represents the support. The photoinsensitive layers such as protective layers, filter layers, intermediate layers, anti-halation layers, subbing layers, etc. are not shown above.

Of these possibilities the preferred structures are those indicated under (1), (2) and (4) above.

Furthermore, the layer structures:

(5) BH/BL/CL/GH/GL/RH/RL/S (6) BH/BL/GH/GL/CL/RH/RL/S disclosed in JP-A-61-34541 are also desirable.

Here, CL signifies a multi-layer effect imparting layer, and the other letters have the same significance as before.

In the case of the layer structure (1), an emulsion of this invention is used in at least one of the BL, GH, GL, RH, RL layers, and the use of an emulsion of which the aspect ratio is from 5 to 8 in the BL layer and the use of emulsions of which the aspect ratio is not more than 5 in the GH, GL, RH and RL layers is preferred.

Moreover, the use of emulsions of this invention of which the aspect ratios are not more than 5 is desirable in all of the GH, GL, RH and RL layers, and a monodispersion of silver halide grains as disclosed in Japanese Patent Applicaiton No. 61-157656 (corresponding to JP-A-63-14145) is preferred in the BH layer.

Furthermore, the use of an emulsion of this invention is preferred for the CL layer in layer structure (5).

In the case of layer structure (6), the use of one of the emulsions of this invention of which the aspect ratio is not more than 5 is especially desirable in as the CL layer.

The emulsions used in the layers other than the CL layer in the layer structures shown in (5) and (6) are the same as those used in the case of layer structure (1).

The silver halide emulsions of this invention are most effective when used in layers other than the outermost layer of a color photosensitive material as aforementioned, but they can also be used in other types of photosensitive material, for example in photosensitive materials for X-ray purposes, in black-and-white camera photosensitive materials, as photosensitive materials for photomechanical process, in printing papers, etc.

The preferred silver halides which are contained in the remaining photographic emulsion layers of photographic materials in which the invention is used are silver iodobromides, silver iodochlorides or silver iodochlorobromides, which contain not more than about 30 mol. % of silver iodide. The use of silver iodobromides which contain from about 2 mol. % to about 25 mol. % of silver iodide is especially desirable.

The silver halide grains in the remaining photographic emulsions can have a regular crystalline form, such as a cubic, octahedral or tetradecahedral form, an irregular crystalline form, such as a spherical or tabular form, they may be grains which have crystal defects such as twinning planes, or they may have a form which is a composite of these forms.

The grain size of the silver halide may be fine at not more than about 0.2 μm, or large such that the projected area diameter is up to about 10 μm, and the emulsions may be polydisperse emulsions or monodisperse emulsions.

The silver halide photographic emulsions which can be used for the balance of the layers in the photographic material of the invention can be prepared using the methods described, for example, in *Research Disclosure* (RD) No. 17643 (December, 1978), pages 22–23, "I, Emulsion Preparation and Types", *Research Disclosure* No. 18716 (November, 1979), page 648; "Chemie et Physique Photographique", by P. Glafkides, published by Paul Montel, (1967); "Photographic Emulsion Chemistry", by G. F. Duffin, published by Focal Press, (1966); and "Making and Coating Photographic Emulsions", by V. L. Zelikman et al., published by Focal Press, (1964), etc.

The monodisperse emulsions disclosed, for example, in U.S. Pat. Nos. 3,574,628 and 3,655,394, and British Patent 1,413,748 are preferred.

Furthermore, tabular grains which have an aspect ratio of at least about 5 can be used in this invention. Tabular grains can be prepared easily using the methods described, for example, by Gutoff in Photographic Science and Engineering, Volume 14, p.248–257 (1970), U.S. Pat. Nos. 4,434,226, 4,414,310, 4,433,048 and 4,439,520, and British Patent 2,112,157.

The crystal structure may be uniform, the interior and exterior parts may have a heterogeneous halogen composition, or they may have a layered structure and, moreover, silver halides which have different compositions may be joined with an epitaxial junction or they may be joined to compounds other than silver halides, such as silver thiocyanate or lead oxide for example.

Mixtures of grains of various crystalline forms may also be used.

The silver halide emulsions used have normally been subjected to physical ripening, chemical ripening and spectral sensitization. Additives used in such processes have been disclosed in *Research Disclosure* Nos. 17643 and 18716 and the locations of these items are summarized in the table below.

Known photographically useful additives which can be used in this invention are also disclosed in the two *Research Disclosures* mentioned above, and the locations of these disclosures are also shown in the table below.

| Type of Additive | RD 17643 | RD 18716 |
|---|---|---|
| 1. Chemical sensitizers | Page 23 | Page 648, right col. |
| 2. Sensitivity increasing agents | | As above |
| 3. Spectral sensitizers Supersensitizers | Pages 23–24 | Pages 648 right col. to 649 right col. |
| 4. Whiteners | Page 24 | |
| 5. Anti-foggants and Stabilizers | Pages 24–25 | Page 649 right col. |
| 6. Light absorbers, filter dyes, UV Absorbers | Pages 25–26 | Pages 649, right col. to 650, left col. |
| 7. Anti-staining agents | Page 25, right col. | Page 650 left–right col. |
| 8. Dye image stabilizers | Page 25 | |
| 9. Hardening agents | Page 26 | Page 651, left col. |
| 10. Binders | Page 26 | As above |
| 11. Plasticizers, Lubricants | Page 27 | Page 650, right col. |
| 12. Coating aids, Surfactants | Pages 26–27 | As above |

-continued

| Type of Additive | RD 17643 | RD 18716 |
|---|---|---|
| 13. Anti-static agents | Page 27 | As above |

Various color couplers can be used in this invention, and actual examples have been disclosed in the patents disclosed in the aforementioned *Research Disclosure* (RD) No. 17643, VII-C ~G.

Those disclosed, for example, in U.S. Pat. Nos. 3,933,501, 4,022,620, 4,326,024 and 4,401,752, JP-B-58-10739 and British Patents 1,425,020 and 1,476,760 are the preferred yellow couplers. (The term "JP-B" as used herein means as "examined Japanese patent publication".)

The 5-pyrazolone and pyrazoloazole based compounds are preferred as magenta couplers, and those disclosed, for example, in U.S. Pat. Nos. 4,310,619 and 4,351,897, European Patent 73,636, U.S. Pat. Nos. 3,061,432 and 3,725,067, Research Disclosure No. 24220 (June, 1984), JP-A-60-33552, Research Disclosure No. 24230 (June, 1984), JP-A-60-43659 and U.S. Pat. Nos. 4,500,630 and 4,540,654 are especially desirable.

Phenol and naphthol based couplers are used as cyan couplers, and those disclosed, for example, in U.S. Pat. Nos. 4,052,212, 4,146,396, 4,228,233, 4,296,200, 2,369,929, 2,801,171, 2,772,162, 2,895,826, 3,772,002, 3,758,308, 4,334,011 and 4,327,173, West German Patent Application (OLS) No. 3,329,729, European Patent 121,365A, U.S. Pat. Nos. 3,446,622, 4,333,999, 4,451,559 and 4,427,767, and European Patent 161,626A are preferred.

The colored couplers for correcting the unwanted absorptions of the colored dyes disclosed, for example, in Research DisclosureNo. 17643 section VII-G, U.S. Pat. Nos. 4,163,670, JP-B-57-39413, U.S. Pat. Nos. 4,004,929 and 4,138,258, and British Patent 1,146,368, are preferred.

The couplers of which the colored dyes have a suitable degree of difusibility disclosed in U.S. Pat. No. 4,366,237, British Patent 2,125,570, European Patent 96,570 and West German Patent Application (OLS) No. 3,234,533 are preferred.

Typical examples of polymerized dye forming couplers have been disclosed, for example, in U.S. Pat. Nos. 3,451,820, 4,080,211 and 4,367,282, and British Patent 2,102,173.

The use of couplers which release residual groups which are useful photographically on coupling can also be used in this invention. The DIR couplers which release development inhibitors disclosed in the patents disclosed in the aforementioned Research Disclosure No. 17643, section VII - F, JP-A-57-151944, JP-A-57-154234, JP-A-60-184248, and U.S. Pat. No. 4,248,962 are preferred.

The couplers disclosed in British Patents 2,097,140 and 2,131,188, JP-A-59-157638 and JP-A-59-170840 are preferred as couplers which imagewise release nucleating agents or development accelerators during development.

Other couplers which can be used in the photosensitive materials of this invention include the competitive couplers disclosed, for example, in U.S. Pat. No. 4,130,427, the poly-equivalent couplers disclosed in U.S. Pat. Nos. 4,283,472, 4,338,393 and 4,310,618, etc., the DIR redox compound releasing couplers, DIR redox compound releasing redox compounds, DIR coupler releasing couplers, or DIR coupler releasing redox compounds disclosed, for example, in JP-A-60-185950 and JP-A-62-24252, the couplers which release a dye to which color is restored after elimination as disclosed in European patent 173,302A, the couplers which release a bleaching accelerator as disclosed, for example, in Research Disclosure Nos. 11449 and 24241, and JP-A-61-201247, and the couplers which release ligands as disclosed, for example, in U.S. Pat. No. 4,553,477.

The couplers which are used in the invention can be introduced into the photosensitive materials using the various known methods of dispersion.

Examples of high boiling solvents which can be used in the oil in water dispersion methods have been disclosed, for example, in U.S. Pat. No. 2,322,027.

Actual examples of high boiling organic solvents of boiling point above 175° C. at normal pressure which can be used in the oil in water dispersion method include phthalate esters (for example, dibutyl phthalate, dicyclohexyl phthalate, di-2-ethylhexyl phthalate, decyl phthalate, bis(2,4-di-tert-amylphenyl) phthalate, bis(2,4-di-tert-amylphenyl) isophthalate, bis(1,1-diethylpropyl) phthalate, etc.), esters of phosphoric acid and phosphonic acid (for example, triphenyl phosphate, tricresyl phosphate, 2-ethylhexyl diphenyl phosphate, tricyclohexyl phosphate, tri-2-ethylhexyl phosphate, tridodecyl phosphate, tributoxyethyl phosphate, trichloropropyl phosphate, di-2-ethylhexylphenyl phosphonate, etc.), benzoic acid esters (for example, 2-ethylhexyl benzoate, dodecyl benzoate, 2-ethylhexyl-p-hydroxybenzoate, etc.), amides (for example, N,N-diethyldodecanamide, N,Ndiethyllaurylamide, N-tetradecylpyrrolidone, etc.), alcohols or phenols (for example, isostearyl alcohol, 2,4-di-tert-amylphenol, etc.), aliphatic carboxylic acid esters (for example, bis(2-ethylhexyl) sebacate, dioctyl azelate, glycerol tributyrate, isostearyl lactate, trioctyl citrate, etc.), aniline derivatives (for example, N,N-dibutyl-2-butoxy-5-tert-octylaniline, etc.) and hydrocarbons (for example, paraffins, dodecylbenzene, diisopropylnaphthalene, etc.). Organic solvents of boiling point above about 30° C., and preferably of above 50° C., but below about 160° C. can be used as auxiliary solvents, and typical examples of such solvents include ethyl acetate, butyl acetate, ethyl propionate, methyl ethyl ketone, cyclohexanone, 2-ethoxyethyl acetate, dimethylformamide, etc.

The processes and effects of the latex dispersion method, and actual examples of latexes for loading, have been disclosed, for example, in U.S. Pat. No. 4,199,363, and West German Patent Application (OLS) Nos. 2,541,274 and 2,541,230.

The invention can be applied to various types of color photosensitive material. Typical examples include color negative films for general and cinematographic purposes, color reversal films for slide and television purposes, color papers, color positive films, color reversal papers, etc.

Suitable supports which can be used in the invention have been disclosed, for example, on page 28 of the aforementioned *Research Disclosure* No. 17643, and from the right hand column on page 647 to the left hand column on page 648 of the aforementioned *Research Disclosure* No. 18716.

Color photographic materials of this invention can be developed and processed using the normal methods disclosed on pages 28–29 of the aforementioned *Research Disclosure* No. 17643 and in the left and right hand columns of page 651 of *Research Disclosure* No. 18716.

The color development baths used in the development processing of photosensitive materials of this invention are preferably aqueous alkaline solutions which contain aromatic primary amine based color developing agents as the principal components. Aminophenol based compounds are useful as color developing agents, but the use of p-phynylenediamine based compounds is preferred. Typical examples of these compounds include 3-methyl-4-amino-N,N-diethylaniline, 3-methyl-4-amino-N-ethyl-N-β-hydroxyethylaniline, 3-methyl-4-amino-N-ethyl-N-β-methanesulfonamidoethylaniline, 3-methyl-4-amino-N-ethyl-N-β-methoxyethylaniline, and the sulfate, hydrochloride and p-toluenesulfonate salts of these compounds. Two or more of these compounds can be used conjointly, depending on the intended purpose.

The color development baths generally contain pH buffers, such as the carbonates, borates or phosphates of the alkali metals, and development inhibitors or antifogging agents, such as bromides, iodides, benzimidazoles, benzothiazoles, mercapto compounds, etc. They may also contain, as required, various preservatives, such as hydroxylamine, diethylhydroxylamine, sulfites, hydrazines, phenylsemicarbazides, triethanolamine, catechol sulfonic acids, triethylenediamine(1,4-diazabicyclo[2,2,-2]octane), etc., organic solvents such as ethylene glycol and diethylene glycol, development accelerators such as benzyl alcohol, poly(ethylene glycol), quaternary ammonium salts and amines, dye forming couplers, competitive couplers, fogging agents such as sodium borohydride, auxiliary developing agents such as 1-phenyl-3-pyrazolidone, viscosity imparting agents, various chelating agents, as typified by the aminopolycarboxylic acids, aminopolyphosphonic acids, alkylphosphonic acids and phosphonocarboxylic acids, typical examples of which include ethylenediamine tetraacetic acid, nitrilotriacetic acid, diethylenetriamine pentaacetic acid, cyclohexanediamine tetraacetic acid, hydroxyethyliminodiacetic acid, 1-hydroxyethylidene-1,1-diphosphonic acid, nitrilo-N,N,N-trimethylenephosphonic acid, ethylenediamine-N,N,N'N'-hydroxyphenylacetic acid), and salts of these compounds.

Color development is carried out after a normal black-and-white development in the case of reversal processing. The known black-and-white developing agents, for example the dihydroxybenzenes such as hydroquinone, etc., the 3-pyrazolidones such as 1-phenyl-3-pyrazolidone, etc., and the amino phenols such as N-methyl-p-aminophenol, etc., can be used individually, or in combinations, as the black-and-white developing agent.

The pH of these color developers and black-and-white developers is generally within the range from 9 to 12. Furthermore, the replenishment rate of the development bath depends on the color photographic material which is being processed, but it is generally not more than 3 liters per square meter of photosensitive material, and it is possible, by reducing the bromide ion concentration in the replenisher, to use a replenishment rate of not more than 500 ml per square meter of photosensitive material. The prevention of loss of liquid by evaporation, and aerial oxidation, by minimizing the contact area with the air in the processing tank is desirable in cases where the replenishment rate is low. Furthermore, the replenishment rate can be reduced by using a means of suppressing the accumulation of bromide ion in the developer.

The photographic emulsion layers are normally subjected to a bleaching process after color development. The bleaching process may be carried out at the same time as the fixing process (in a bleach-fix process) or it may be carried out as a separate process. Moreover, a bleach-fix process can be carried out after a bleaching process in order to speed-up processing. Moreover processing can be carried out in two connected bleach-fix baths, a fixing process can be carried out before carrying out a bleach-fix process or bleaching process can be carried out after a bleach-fix process, according to the intended purpose of the processing. Compounds of a multi-valent metal such as iron(III), cobalt(III), chromium(VI), copper(II), etc., peracids, quinines, nitro compounds, etc. can be used as bleaching agents. Typical bleaching agents include ferricyanides; dichromates; organic complex salts of iron(III) or cobalt(III), for example, complex salts wit aminopolycarboxylic acids, such as ethylenediamine tetraacetic acid, diethylenetriamine pentaacetic acid, cyclohexanediamine tetraacetic acid, methylimino diacetic acid, 1,3-diaminopropane tetraacetic acid, glycol ether diamine tetraacetic acid, etc., or citric acid, tartaric acid, malic acid, etc.; persulfates; bromates; permanganates; nitrobenzenes; etc. Of these materials, the use of the aminopolycarboxylic acid iron(III) complex salts, principally ehtylenediamine tetraacetic acid iron(III) complex salts, and persulfates, is preferred from the points of view of both rapid processing and the prevention of environmental pollution. Moreover, the amino polycarboxylic acid iron(III) complex salts are especially useful in both bleach baths and bleach-fix baths. The pH of a bleach or bleach-fix bath in which aminopolycarboxylic acid iron(III) complex salts are being used is normally from 5.5 to 8, but processing can be carried out at lower pH values in order to speed-up processing.

Bleach accelerators can be used, as required, in the bleach baths, bleach-fix baths, or bleach or bleachfix pre-baths. Actual examples of useful bleach accelerators have been disclosed in the following specifications: Thus there are the compounds which have a mercapto group or a disulfide group disclosed, for example, in U.S. Pat. No. 3,893,858, West German Patents 1,290,812 and 2,059,988, JP-A-53-32736, JP-A-53-57831, JP-A-53-37418, JP-A-53-73623, JP-A-53-95630, JP-A-53 95631, JP-A-53-104232, JP-A-53-124424, JP-A-53-141623, JP-A-53-28426, and *Research Disclosure* No. 17129 (July, 1978); the thiazolidine derivatives disclosed in JP-A-50-140129; the thiourea derivatives disclosed in JP-B-45-8506, JP-A-52-20832, JP-A-53-32735, and U.S. Pat. No. 3,706,561; the iodides disclosed in West German Patent 1,127,715 and JP-A-58-16235; the polyoxyethylene compounds disclosed in West German Patents 966,410 and 2,748,430; the polyamine compounds disclosed in JP-B-45-8836; the other compounds disclosed in JP-A-49-42434, JP-A-49-59644, JP-A-53-94927, JP-A-54-35727, JP-A-55-26506 and JP-A-58-163940; bromide ions; etc. Among these compounds those which have a mercapto group or a disulfide group are preferred in view of their large accelerating effect, and the use of the compounds disclosed in U.S. Pat. No. 3,893,858, West German Patent 1,290,812 and JP-A-53-95630 is especially desirable. Moreover, the use of the compounds disclosed in U.S. Pat. No. 4,552,834 is also desirable. These bleach accelerators may be added to the photosensitive material. These bleach accelerators are especially effective when bleach-fixing camera color photosensitive materials.

Thiosulfates, thiocyanates, thioether based compounds, thioureas and large quantities of iodides etc. can be used as fixing agents, but thiosulfates are generally used for this purpose, and ammonium thiosulfate in particular can be used in the widest range of applications. Sulfites or bisulfites, or carbonylbisulfite addition compounds, are the preferred preservatives for bleach-fix baths.

The silver halide color photographic materials of this invention are generally subjected to a water washing and/or stabilizing process after the desilvering process. The amount of water used in the water washing process can be fixed within a wide range according to the nature of the photosensitive material (for example the materials, such as the couplers, which are being used), the application thereof, the wash water temperature, the number of washing tanks (the number of washing stages), the replenishment system, i.e. whether a counter-current or a sequential-current system is used, and various other conditions. The relationship between the amount of water used and the number of water washing tanks in a multistage counter-current system can be obtained using the method outlined on pages 248–253 of the Journal of the Society of Motion Picture and Television Engineers, Volume 64 (May, 1955).

The amount of wash water can be greatly reduced by using the multi-stage counter-current system noted in the aforementioned literature, but bacteria proliferate due to the increase residence time of the water in the tanks and in addition problems arise as a result of the sediments which are formed becoming attached to the photosensitive material. The method in which the calcium ion and manganese ion concentrations are reduced as disclosed in Japanese Patent Application No. 61-131632 (corresponding to JP-A-62-288838) can be used very effectively to overcome problems of this sort in the processing of color photosensitive materials of this invention. Furthermore, the isothiazolone compounds and thiabenzazoles disclosed in JP-A-57-8542 and the chlorine based disinfectants such as chlorinated sodium isocyanurate, and benzotriazoles, etc., and the disinfectants disclosed in "Chemistry of Biocides and Fungicides" by Horiguchi, "Reduction of Micro-organisms, Biocidal and Fungicidal Techniques", published by the Health and Hygiene Technical Society and in "A Dictionary of Biocides and Fungicides", published by the Japanese Biocide and Fungicide Society, can be used for this purpose.

The pH value of the wash water used in the processing of the photosensitive materials of invention is preferably within the range from 4 to 9, and more preferably within the range from 5 to 8. The wash water temperature and the washing time can be set variously according to the nature of the photosensitive material, the application, etc. but, in general, washing conditions of from 20 seconds to 10 minutes at a temperature of from 15° to 45° C., and preferably of from 30 seconds to 5 minutes at a temperature of from 25° to 40° C., are selected. Moreover, the photosensitive materials of this invention can be processed directly in a stabilizing bath instead of being subjected to a water wash as described above. The known methods disclosed in JP-A-57-8543, JP-A-58-14834 and JP-A-60-220345 can all be used for this purpose.

Furthermore, there are cases in which a stabilization process is carried out following the aforementioned water washing process and the stabilizing baths which contain formalin and surfactant which are used as a final bath for camera color photosensitive materials are an example of such a process. Various chelating agents, fungicides, etc. can be added to these stabilizing baths.

The overflow which accompanies replenishment of the above mentioned wash water and/or stabilizer can be reused in other processes such as the desilvering process etc.

A color developing agent may also be incorporated into the silver halide color photosensitive materials of this invention in order to simplify and speed-up processing. The incorporation of various color developing agent precursors is preferred. For example, the indoaniline based compounds disclosed in U.S. Pat. No. 3,342,597, the Schiff's base type compounds disclosed in U.S. Patent 3,342,599 and *Research Disclosure* Nos. 14850 and 15159, the aldol compounds disclosed in Research Disclosure No. 13924, the metal salt complexes disclosed in U.S. Pat. No. 3,719,492, and the urethane based compounds disclosed in JP-A-53-135628 can be used for this purpose.

Various 1-phenyl-3-pyrazolidones can be incorporated, as required, into the silver halide color photosensitive materials of this invention with a view to accelerating color development. Typical compounds of this type have been disclosed, for example, in JP-A-56-64339, JP-A-57-144547 and JP-A-58-115438.

The various processing baths in this invention may be at a temperature of from 10° C. to 50° C.. The standard temperature is normally from 33° C. to 38° C., but processing is accelerated and the processing time is shortened at higher temperatures and, conversely, increased image quality and improved stability of the processing baths can be achieved at lower temperatures. Furthermore, processes using hydrogen peroxide intensification or cobalt intensification as disclosed in West German Patent 2,226,770 and U.S. Pat. No. 3,674,499 can be carried out in order to economize on silver in the photosensitive material.

Furthermore, silver halide photosensitive materials of this invention can also be used as heat developable photosensitive materials as disclosed, for example, in U.S. Pat. No. 4,500,626, JP-A-60-133449, JP-A-59-218443, JP-A-61-238056, and European Patent 210,660A2.

The invention is described by means of examples below.

EXAMPLE 1

Emulsion A

An emulsion was prepared in the way indicated below with reference to Japanese Patent Application No. 61-311130 (corresponding to EP-A-0273411).

(Process A) An aqueous gelatin solution (1,350 ml of water, 17 grams of gelatin, 3.7 grams of KBr, adjusted to pH 6.0 with 1.2 ml of lN KOH solution, pBr 1.47) was introduced into a reactor of capacity 4 liters, the solution temperature was raised to, and maintained at, 45° C. and 67.7 ml of an aqueous silver nitrate solution aqueous solution which contained 0.85 mol/liter of KBr and 0.04 mol/liter of KI were added simultaneously at a constant feed rate over a period of 45 seconds, after which the mixture was left to stand for 5 minutes. The solution temperature was then raised to 65° C., 241 grams of a 10% aqueous gelatin solution was added, and the mixture was left to stand for 30 minutes.

(Process B) Next, an aqueous silver nitrate solution which contained 1.76 mol/liter of $AgNO_3$ and an aqueous halide solution which contained 2.72 mol/liter of KBr and 0.056 mol/liter of KI were added using the double jet method over a period of 60 minutes at 65° C. while maintaining a pBr value of 3.6, the flow rates being increased during the addition (the final flow rate being double the initial flow rate) and the addition was continued until 655 ml of silver nitrate solution had been consumed.

(Process C) After the precipitation had been completed, the emulsion was cooled to 40° C., 1.65 liters of a 15.3% aqueous phthalated gelatin solution was added and the emulsion was washed twice using the coagulation method disclosed in U.S. Pat. No. 2,614,929.

Next, 0.55 liter of a 10.5% solution of bone gelatin was added and the pH and pBr of the emulsion were adjusted to 5.5 and 3.1 respectively at 40° C.

The grains obtained were tabular grains of average grain diameter 0.7 μm and mean aspect ratio 2.0, and which contained 2 mol. % of iodide overall.

Twinning planes were observed on looking at cross sectional photographs of these grains using the method described earlier in this specification. The value of (a) at this time was 0.03 μm, more or less equal to the thickness of the plates obtained at the end of process A, and (b/a) had a value of about 12.

Emulsion B

Emulsion B was prepared in the same way as Emulsion A except that the amount of KBr in the aqueous gelatin solution which was present initially in the reactor for the preparation of Emulsion A was changed from 3.7 grams to 4.2 grams, and the initial amount of gelatin was changed from 17 grams to 21 grams.

Emulsion C

Emulsion C was prepared in the same way as Emulsion A except that the amount of KBr in the aqueous gelatin solution which has present initially in the reactor for the preparation of Emulsion A was changed from 3.7 grams to 5.2 grams, and the initial amount of gelatin was changed from 17 grams to 26 grams.

Emulsion D

Emulsion D was prepared in the same way as Emulsion A except that the amount of KBr in the aqueous gelatin solution which was present initially in the reactor for the preparation of Emulsion A was changed from 3.7 grams to 7.5 grams, and the initial amount of gelatin was changed from 17 grams to 32 grams.

Emulsion E

Emulsion E was prepared in the same way as Emulsion A except that the amount of KBr in the aqueous gelatin solution which was present initially in the reactor for the preparation of Emulsion A was changed from 3.7 grams to 12 grams, and the initial amount of gelatin was changed from 17 grams to 40 grams.

Emulsion F

Emulsion F was prepared in the same way as Emulsion B except that the 0.1 gram of KI was also introduced into the gelatin solution which was present initially in the reactor for the preparation of Emulsion B prior to the introduction of silver salt and halogen salt.

Emulsion G

Emulsion G was prepared in the same way as Emulsion B except that the 0.03 grams of KI was also introduced into the gelatin solution which was present initially in the reactor for the preparation of Emulsion B.

Emulsions H and I

Emulsions H and I were prepared in the same as Emulsions A and B way except that the pBr in process B in the preparation of Emulsions A and B was changed from 3.7 to 2.0.

Emulsion J

Emulsion J was prepared in the same as Emulsion G way except that the pBr value in process B in the preparation of Emulsion G was changed from 3.7 to 2.0.

Emulsion K (Seed Crystals) An aqueous gelatin solution (1 liter of water, 45 grams of gelatin, 0.3 gram of KBr) was introduced into a reactor which had a capacity of 4 liters, and an aqueous halide solution which contained 3.43 mol/liter of KBr and 0.07 mol/liter of KI, and an aqueous silver nitrate solution which contained 3.5 mol/liter of $AgNO_3$ were added, at pH 5.6, using the double jet method, until 1 liter of the aqueous silver nitrate solution had been consumed, while maintaining the temperature at 70° C. and the pBr value at 2.3. The addition of the halogen and silver nitrate was carried out in stages in accordance with the method disclosed in German Patent Application (OLS) No. 2,107,118. That is to say, the flow rate was increased in 7 stages at intervals of 1 minute from the start to the finish of the addition, the flow rates being 19.65 cc/min, 45.20 cc/min, 78.6 cc/min, 123.80 cc/min, 176.85 cc/min, 241.70 cc/min and 314.4 cc/min.

The solution was cooled to 40° C. and a 10% aqueous phthalated gelatin solution (0.2 liter) was added after the precipitate had been formed, and the emulsion was washed twice using the coagulation method disclosed in U.S. Pat. No. 2,614,929. Next, 1.0 liter of a 10.5% solution of bone gelatin was added and the pH and the pBr of the emulsion at 40° C. were adjusted to 5.5 and 3.1 respectively.

(Growth) The aforementioned seed crystals (279 grams, 0.3 mol) were added to 1 liter of an aqueous gelatin solution (3.75% phthalated gelatin) in a reactor of capacity 4 liters and the mixture was agitated at pH 5.8. Next an aqueous solution which contained 3.43 mol/liter of KBr and 0.07 mol/liter of KI, and an aqueous silver nitrate solution which contained 3.5 mol/liter of $AgNO_3$ were added using the double jet method at 70° C. while maintaining the pAg value at 8.3 until 0.931 liter of the aqueous silver nitrate solution had been consumed. The aqueous halide and silver nitrate solutions were added in stages in accordance with the method disclosed in German Patent Application (OLS) No. 2,107,118, which is to say that the flow rates were increased every 4 minutes to 18.5 cc/min, 22.2 cc/min, 27.7 cc/min, 33.3 cc/min, 37.0 cc/min, 44.3 cc/min and 49.9 cc/min between the start and completion of the addition.

After precipitation and formation, 0.37 liter of a 10% aqueous solution of phthalated gelatin was added at 40° C. and the emulsion was washed twice using the coagulation method disclosed in U.S. Pat. No. 2,614,929.

Next, 1.0 liter of a 10.5% aqueous solution of bone gelatin was added and the pH and pBr values at 40° C. were adjusted to 5.5 and 3.1 respectively.

Emulsion L (Process A) An aqueous gelatin solution (1,350 ml of water, 17 grams of gelatin, 3.7 grams of KBr, adjusted to pH 6.0 with 1.2 ml of lN KOH solution, pBr 1.47) was introduced into a reactor of capacity 4 liters, the solution temperature was raised to, and maintained at, 45° C. and 67.7 ml of an aqueous silver nitrate solution containing 0.90 mol/liter of $AgNO_3$ and 67.7 ml of an aqueous solution which contained 0.85 mol/liter of KBr and 0.04 mol/liter of KI were added simultaneously at a constant feed rate over a period of 45 seconds, after which the mixture was left to stand for 5 minutes. The solution temperature was then raised to 65° C., 241 grams of a 10% aqueous gelatin solution was added and the mixture was left to stand for 30 minutes.

(Process B) Next, an aqueous silver nitrate solution which contained 1.76 mol/liter of $AgNO_3$ and an aqueous halide solution which contained 2.72 mol/liter of KBr and 0.056 mol/liter of KI were added using the double jet method over a period of 30 minutes while maintaining a pBr value of 3.6, the flow rates being increased during the addition (the final flow rate being double the initial flow rate) and the addition was continued until 300 ml of silver nitrate solution had been consumed.

(Process C) Ten cc of an aqueous solution containing 2 mol/liter of KI was added. Next, an aqueous silver nitrate solution containing 1.76 mol/liter of $AgNO_3$ and an aqueous halide solution containing 2.72 mol/liter of KBr were added with the double jet method over a period of 20 minutes while maintaining a pBr value of 3.6, the flow rate being increased during the addition (to become double the initial flow rate at the end of the addition) until 355 ml of aqueous silver nitrate solution had been consumed.

(Process D) This was the same as process C used in the preparation of Emulsion A. The grains obtained had an overall iodide content of 2 mol.% and they were tabular grains of average grain diameter 0.7 μm, and of mean aspect ratio 2.

Emulsion M

Emulsion M through R were prepared in the same way as Emulsion L with the following differences.

Emulsion M was prepared in the same way except that the amount of KBr in the aqueous gelatin solution which was present initially in the reactor for the preparation of Emulsion L was changed from 3.7 grams to 4.2 grams, and the amount of gelatin was changed from 17 grams to 21 grams.

Emulsion N

Emulsion N was prepared in the same way except that the amount of KBr in the gelatin solution which was present initially in the reactor for the preparation of Emulsion L was changed from 3.7 grams to 5.2 grams, and the amount of initial gelatin was changed from 17 grams to 6 grams.

Emulsion O

Emulsion O was prepared in the same way except that the amount of aqueous solution which contained 2 mol/liter of KI which was added initially in process C in the preparation of Emulsion L was changed from 10 cc to 5 cc.

Emulsion P

Emulsion P was prepared in the same way except that the amount of aqueous solution which contained 2 mol/liter of KI which was added initially in process C in the preparation of Emulsion L was changed from 10 cc to 20 cc.

Emulsion Q

Emulsion Q was prepared in the same way except that 0.1 gram of KI was also introduced into the aqueous gelatin solution which was present initially in the reactor in the preparation of Emulsion L.

Emulsion R

Emulsion R was prepared in the same way except that 0.03 grams of KI was also introduced into the aqueous gelatin solution which was present initially in the reactor in the preparation of Emulsion L.

Emulsions S and T

Emulsions S and T were prepared in the same way as Emulsions L and M except that the pBr value in process B in the preparation of Emulsions L and M was changed from 3.6 to 2.6.

Emulsion U

Emulsion U was prepared in the same way as Emulsion R except that the pBr in process B in the preparation of Emulsion R was changed from 3.6 to 2.0.

A summary of the emulsions prepared is shown in Table 1.

The (b/a) ratio was obtained by observing the cross sections of grains using an electron microscope in accordance with the method outlined below.

A coated sample in which the tabular grains were arranged parallel to one another was cut with a diamond knife to provide a slice of thickness about 0.1 μm, and the twinning planes of the twin silver halide grains were detected by observing the slice with a transmission type electron microscope. Electron micrographs were obtained, the distance (a) of the twinning planes and the grain thickness (b) were measured from the photographs, and the ratio (b/a) was obtained by calculation.

Emulsions A to U were all chemically sensitized optimally and then they were spectrally sensitized optimally for the green region of the spectrum in accordance with the conditions shown in Table 2 below.

TABLE 1

Summary of the Emulsions in Example 1

| Emulsion | Iodide Content | Proportion of Grains with (b/a) ≧ 10 | Proportion of Grains with (b/a) ≧ 5 | Aspect Ratio | Proportion of Grains with 10 or more Dislocations per Grain |
|---|---|---|---|---|---|
| EmA (Comp. Ex.) | 2 | 95% | 100% | 2 | 0% |
| EmB (Comp. Ex.) | 2 | 60% | 100% | 2 | 0% |

TABLE 1-continued

Summary of the Emulsions in Example 1

| Emulsion | Iodide Content | Proportion of Grains with (b/a) ≧ 10 | Proportion of Grains with (b/a) ≧ 5 | Aspect Ratio | Proportion of Grains with 10 or more Dislocations per Grain |
|---|---|---|---|---|---|
| EmC (Comp. Ex.) | 2 | 5% | 95% | 2 | 10% |
| EmD (Comp. Ex.) | 2 | 0% | 60% | 2 | 20% |
| EmE (Comp. Ex.) | 2 | 0% | 30% | 2 | 40% |
| EmF (Comp. Ex.) | 2 | 30% | 95% | 2 | 0% |
| EmG (Comp. Ex.) | 2 | 60% | 95% | 2 | 0% |
| EmH (Comp. Ex.) | 2 | 5% | 95% | 6 | 5% |
| EmI (Comp. Ex.) | 2 | 0% | 60% | 6 | 40% |
| EmJ (Comp. Ex.) | 2 | 0% | 30% | 6 | 40% |
| EmK (Comp. Ex.) | 2 | — | — | Octahedral | 0% |
| EmL (Invention) | 2 | 95% | 100% | 2 | 60% |
| EmM (Invention) | 2 | 60% | 100% | 2 | 70% |
| EmN (Invention) | 2 | 5% | 95% | 2 | 80% |
| EmO (Invention) | 2 | 0% | 60% | 2 | 90% |
| EmP (Comp. Ex.) | 2 | 0% | 30% | 2 | 90% |
| EmQ (Invention) | 2 | 30% | 95% | 2 | 60% |
| EmR (Invention) | 2 | 60% | 95% | 2 | 70% |
| EmS (Invention) | 2 | 5% | 95% | 6 | 80% |
| EmT (Invention) | 2 | 0% | 60% | 6 | 80% |
| EmU (Comp. Ex.) | 2 | 0% | 30% | 6 | 80% |

TABLE 2

Post ripening Conditions for the Emulsions of Example 1

| | Chemical Sensitization | | | | | Spectrally Sensitizing dye A (mg/mol of Ag) |
|---|---|---|---|---|---|---|
| | Gold (mg/mol of Ag) | Sulfur (mg/mol of Ag) | Thiocyanate (mg/mol of Ag) | Ripening Time | Temperature | |
| EmA | 3.5 | 10.0 | 200 | 30 min. | 70° C. | 400 |
| EmB | 3.5 | " | " | " | " | 400 |
| EmC | 3.5 | " | " | " | " | 400 |
| EmD | 3.5 | " | " | " | " | 400 |
| EmE | 3.5 | " | " | " | " | 400 |
| EmF | 3.5 | " | " | " | " | 400 |
| EmG | 3.5 | " | " | " | " | 400 |
| EmH | 3.5 | " | " | " | " | 700 |
| EmI | 3.5 | " | " | " | " | 700 |
| EmJ | 3.5 | " | " | " | " | 700 |
| EmK | 3.5 | " | " | " | " | 350 |
| EmL | 3.5 | " | " | " | " | 400 |
| EmM | 3.5 | " | " | " | " | 400 |
| EmN | 3.5 | " | " | " | " | 400 |
| EmO | 3.5 | " | " | " | " | 400 |
| EmP | 3.5 | " | " | " | " | 400 |
| EmQ | 3.5 | " | " | " | " | 400 |
| EmR | 3.5 | " | " | " | " | 400 |
| EmS | 3.5 | " | " | " | " | 700 |
| EmT | 3.5 | " | " | " | " | 700 |
| EmU | 3.5 | " | " | " | " | 700 |

Gold: Potassium tetrachlorroaurate
Sulfur: Sodium thiosulfate pentahydrate
Thiocyanate: Sodium thiocyanate
Dye A: Anhydro-5-chloro-9-ethyl-5'-phenyl-3'-(3-sulfobutyl)-3-(3-sulfopropyl)oxacarbo~~cyanine hydroxide,~~ sodium salt Samples 1 to 21 were prepared by coating Emulsions A to U, and a protective layer, at the rates shown in Table 3 below, onto triacetylcellulose film supports on which a subbing layer had been established.

TABLE 3

| | |
|---|---|
| (1) Emulsion Layer | |
| Emulsion (as shown in Table 1) | |
| A–U as silver, | $2.1 \times 10^{-2}$ mol/m$^2$ |
| Coupler | $1.5 \times 10^{-3}$ mol/m$^2$ |

TABLE 3-continued

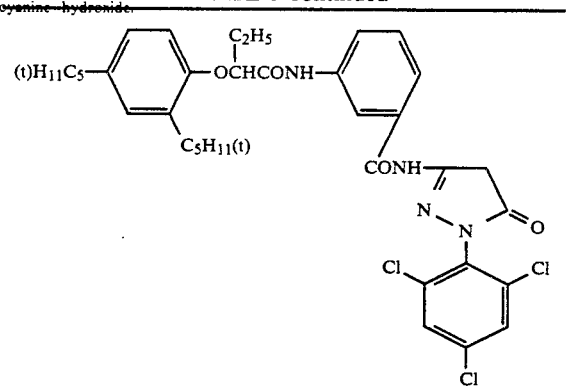

| | |
|---|---|
| Tricresyl phosphate | 1.10 g/m$^2$ |
| Gelatin | 2.30 g/m$^2$ |
| (Protective Layer) | |
| 2,4-Dichlorotriazine-6-hydroxy-s-triazine.sodium salt | 0.08 g/m$^2$ |
| Gelatin | 1.80 g/m$^2$ |

These samples were left to stand for 14 hours under conditions of 40° C., 70% relative humidity, after which they were given an exposure for sensitometric purposes and subjected to a color development process.

The processed samples were subjected to density measurements using a green filter.

The color development processing was carried out using the method indicated below.

TABLE A

| Process | Processing Method: Processing Time | Processing Temp. |
|---|---|---|
| Color Development | 3 min. 15 sec. | 38° C. |
| Bleaching | 6 min. 30 sec. | 38° C. |
| Water Wash | 2 min. 10 sec. | 24° C. |
| Fixing | 4 min. 20 sec. | 38° C. |
| Water Wash (1) | 1 min. 05 sec. | 24° C. |
| Water Wash (2) | 1 min. 00 sec. | 24° C. |
| Stabilization | 1 min. 05 sec. | 38° C. |
| Drying | 4 min. 20 sec. | 55° C. |

The compositions of the processing baths used are indicated below.

| | (Units: Grams) |
|---|---|
| Color Development Bath | |
| Diethylenetriamine pentaacetic acid | 1.0 |
| 1-Hydroxyethylidene-1,1-diphosphonic acid | 3.0 |
| Sodium sulfite | 4.0 |
| Potassium carbonate | 30.0 |
| Potassium bromide | 1.4 |
| Potassium iodide | 1.5 mg |
| Hydroxylamine sulfate | 2.4 |
| 4-(N-Ethyl-N-β-hydroxyethylamino)-2-methylaniline sulfate | 4.5 |
| Water | to make up to 1.0 liter |
| pH | 10.05 |
| Bleach Bath | |
| Ammonium ethylenediaminetetraacetato ferrate trihydrate | 100.0 |
| Disodium ethylenediaminetetraacetate | 10.0 |
| Ammonium bromide | 140.0 |
| Ammonium nitrate | 30.0 |
| Aqueous ammonia (27%) | 6.5 ml |
| Water | to make up to 1.0 liter |
| pH | 6.0 |
| Fixing Bath | |
| Disodium ethylenediaminetetraacetate | 0.5 |
| Sodium sulfite | 7.0 |
| Sodium bisulfite | 5.0 |
| Aqueous ammonium thiosulfate solution (70%) | 170.0 ml |
| Water | to make up to 1.0 liter |
| pH | 6.7 |
| Stabilizer Bath | |
| Formalin (37%) | 2.0 ml |
| Polyoxyethylene-p-nonylphenyl ether (average degree of polymerization 10) | 0.3 |
| Disodium ethylenediaminetetraacetate | 0.05 |
| Water | to make up to 1.0 liter |
| pH | 5.0-8.0 |

Exposure were made under two conditions with exposures of 1/100th of a second and 10 seconds, and the sensitivity at each exposure was expressed as a relative value of the reciprocal of the exposure in Lux seconds required to provide a density of fog +0.2, the sensitivity obtained for the 1/100th of a second exposure with Sample 1 being taken as 100.

The RMS granularity was measured by uniformly exposing the samples to the amount of light required to achieve a density of fog +0.2 and then developing and processing the samples in the way described earlier, after which measurements were made using a G filter in accordance with the method described on page 619 of "The Theory of the Photographic Process", published by Macmillan. RMS granularity is defined as the equation (21.77) described on page 619 of "The Theory of the Photographic Process", 4th edition published by Macmillan Publishing Co., Inc.

Sharpness was measured by measuring the MTF. The MTF measurements were made using the method described in the "Journal of Applied Photographic Engineering", Volume 6 (1), pages 1-8 (1980). However, the development processing only was carried out using the method described earlier in the example section. The MTF value was expressed as a relative value, taking the value for Sample 1 to be 100. The gradation was expressed as the reciprocal of the difference between the logarithm of the exposure in lux.seconds which gave a density of 0.5 and the logarithm of the exposure in lux seconds which gave a density of 1.5 when the samples were exposed for sensitometric purposes. The values obtained were expressed as relative values, taking the value obtained for Sample 1 to be 100. Pressure characteristics were evaluated in the following way. Thus, coated film samples were flexed under conditions of 25° C., 40% relative humidity. The flexing was carried out through 180° around a steel bar of diameter 1 mm, an the samples were then subjected immediately to a sensitometric exposure of 10-2 second duration. The exposed samples were developed and processed in the same way as described earlier. The results were expressed in terms of the value of the ratio (ΔFog/Dmax), expressed as a percentage, of the difference ΔFog between the fog density in the part of the sample which had been flexed and the fog density in the part of the sample which had not been flexed, with respect to the maximum density, $D_{max}$.

The photographic data for Samples 1 to 21 is shown in Table 4.

TABLE 4

| Sample No. | Emulsion | Photographic Properties of Samples 1 to 21: Sensitivity with 1/100th sec. Exposure | Sensitivity with 10 sec. Exposure | Gradation | RMS Granularity | MTF | Pressure Characteristics ΔFog/$D_{max}$ | |
|---|---|---|---|---|---|---|---|---|
| 1 | A | 100 | 70 | 100 | 0.043 | 100 | 10% | Comparative Ex. |
| 2 | B | 90 | 60 | 97 | 0.046 | 95 | 9% | Comparative Ex. |
| 3 | C | 80 | 55 | 96 | 0.048 | 90 | 9% | Comparative Ex. |
| 4 | D | 75 | 40 | 94 | 0.051 | 88 | 8% | Comparative Ex. |
| 5 | E | 65 | 35 | 94 | 0.053 | 83 | 7% | Comparative Ex. |
| 6 | F | 85 | 55 | 93 | 0.048 | 80 | 9% | Comparative Ex. |
| 7 | G | 85 | 55 | 96 | 0.049 | 78 | 12% | Comparative Ex. |
| 8 | H | 83 | 55 | 93 | 0.050 | 97 | 12% | Comparative Ex. |

TABLE 4-continued

| Sample No. | Emulsion | Sensitivity with 1/100th sec. Exposure | Sensitivity with 10 sec. Exposure | Gradation | RMS Granularity | MTF | Pressure Characteristics ΔFog/$D_{max}$ | |
|---|---|---|---|---|---|---|---|---|
| | | Photographic Properties of Samples 1 to 21 | | | | | | |
| 9 | I | 75 | 40 | 93 | 0.052 | 94 | 12% | Comparative Ex. |
| 10 | J | 65 | 35 | 92 | 0.054 | 82 | 7% | Comparative Ex. |
| 11 | K | 50 | 30 | 95 | 0.054 | 80 | 5% | Comparative Ex. |
| 12 | L | 130 | 110 | 110 | 0.042 | 100 | 2% | This Invention |
| 13 | M | 125 | 110 | 105 | 0.046 | 95 | 2% | This Invention |
| 14 | N | 115 | 105 | 105 | 0.047 | 90 | 1% | This Invention |
| 15 | O | 110 | 100 | 103 | 0.049 | 88 | 2% | This Invention |
| 16 | P | 100 | 95 | 103 | 0.051 | 83 | 1% | Comparative Ex. |
| 17 | Q | 115 | 105 | 103 | 0.047 | 80 | 2% | This Invention |
| 18 | R | 105 | 95 | 105 | 0.049 | 78 | 2% | This Invention |
| 19 | S | 113 | 106 | 102 | 0.049 | 97 | 5% | This Invention |
| 20 | T | 105 | 100 | 102 | 0.052 | 94 | 3% | This Invention |
| 21 | U | 85 | 80 | 102 | 0.054 | 82 | 3% | Comparative Ex. |

On comparing Samples 12 to 21, it is clear that the relationship between sensitivity and graininess, and the sharpness, are improved, and that better contrast is obtained as the proportion of grains in which (b/a)≧5 increases, as the proportion of grains of which (b/a)≧10 increases and with the grains of which the aspect ratio is 2 rather than 7. On comparing Samples 1 to 10 and Sample 11, it is clear that the tabular grains having the mean aspect ratio of 2 were superior in sensitivity and graininess to tne octahedral grains but they were apt to form pressure fog.

On comparing Samples 1 to 10 and Samples 12 to 21 it is clear that Emulsions L to U which contain at least 50% of grains which have at least 10 dislocations per grain (Samples 12–21) have a higher sensitivity and a lower exposure luminance dependence than Emulsions A to J in which such grains account for not more than 50% of the grains (Samples 1 10), and they have better pressure characteristics and high contrast. Thus, emulsions L to O, and Q to T of this invention, which is to say those in which the proportion of grains for which (b/a) ≧5 is greater than 50% and in which at least 50% of the grains have at least 10 dislocations per grain, are clearly superior to the emulsions containing grains which do not satisfy these requirements in respect of the sensitivity/graininess relationship, pressure characteristics, and exposure luminance dependence and they also have higher contrast.

EXAMPLE 2

Twenty types of emulsion as shown in Table 5 were prepared.

Em1, Em2, Em3 and Em4 were prepared on the basis of the illustrative examples in JP-A-52-153428 (corresponding to U.S. Pat. No. 4,184,878).

Em5, Em6. Em7, and Em9 were prepared on the basis of the illustrative examples in JP-A-59-188639.

Em8 and Em10 were prepared on the basis of the illustrative examples in JP-A-58-113926 (corresponding to U S. Patent 4,439,520). Emulsions Emll to Em15 were prepared by controlling the iodide composition by changing the iodide content in process (B) in the preparation of Emulsion A in Example 1 and by controlling the grain thickness by changing the pAg value in process (B).

Em16 to Em20 of this invention were prepared by modifying the method used for the preparation of emulsion L in Example 1 in the way indicated below. Thus, the amounts of gelatin and KBr present initially in the reaction mixture in process (A) in the preparation of Emulsion L, and the temperature in the reactor during the addition of the aqueous silver nitrate solution and aqueous halide solution, were selected appropriately.

The amount of KI in the aqueous halide solution added in process (B) was adjusted so that the iodide content of the silver halide precipitated in process (B) was 4 mol %, and the pBr value during the addition of the aqueous silver nitrate solution and the aqueous halide solution was selected appropriately.

The amount of KI added initially in process (C) was set at 4 mol % of the amount of silver nitrate added subsequently, and the pBr value during the subsequent addition of the aqueous silver nitrate solution and aqueous potassium bromide solution was selected appropriately.

A summary of the Emulsions Em1 to Em20 is shown in Table 5.

TABLE 5

| Emulsion | Iodide Content | Iodide Composition | Average Grain Size (μm) | Grain Size Distribution | Average Value of (b/a) | Mean Aspect Ratio | Proportion of Grains with 10 or more dislocations per grain |
|---|---|---|---|---|---|---|---|
| | | Summary of the Emulsions in Example 2 | | | | | |
| Em1 (Comparative Ex.) | 4 | Uniform | 0.45 | 30 | 3 | 3 | 10% |
| Em2 (Comparative Ex.) | 6 | Internal AgI Type | 0.70 | 30 | 3 | 2 | 10% |
| Em3 (Comparative Ex.) | 2 | Internal AgI Type | 0.78 | 30 | 3 | 3 | 50% |
| Em4 (Comparative Ex.) | 10 | Internal AgI Type | 1.00 | 30 | 3 | 3 | 10% |
| Em5 (Comparative Ex.) | 4 | Uniform | 0.45 | 10 | — | 1 | 0% |
| Em6 (Comparative Ex.) | 6 | Internal AgI Type | 0.70 | 10 | — | 1 | 0% |
| Em7 (Comparative Ex.) | 2 | Internal AgI Type | 0.78 | 10 | — | 1 | 0% |
| Em8 (Comparative Ex.) | 10 | Internal AgI Type | 1.00 | 30 | 7 | 11 | 10% |
| Em9 (Comparative Ex.) | 10 | Internal AgI Type | 1.00 | 10 | — | 1 | 0% |
| Em10 (Comparative Ex.) | 4 | Uniform | 0.45 | 30 | 7 | 11 | 10% |

TABLE 5-continued

Summary of the Emulsions in Example 2

| Emulsion | Iodide Content | Iodide Composition | Average Grain Size (μm) | Grain Size Distribution | Average Value of (b/a) | Mean Aspect Ratio | Proportion of Grains with 10 or more dislocations per grain |
|---|---|---|---|---|---|---|---|
| Em11 (Comparative Ex.) | 4 | Uniform | 0.78 | 20 | 10 | 3 | 10% |
| Em12 (Comparative Ex.) | 4 | Uniform | 0.70 | 20 | 12 | 3 | 5% |
| Em13 (Comparative Ex.) | 4 | Uniform | 0.45 | 20 | 12 | 3 | 5% |
| Em14 (Comparative Ex.) | 4 | Uniform | 1.00 | 30 | 7 | 7 | 10% |
| Em15 (Comparative Ex.) | 4 | Uniform | 0.45 | 30 | 7 | 7 | 10% |
| Em16 (This Invention) | 4 | Uniform | 0.76 | 20 | 10 | 3 | 60% |
| Em17 (This Invention) | 4 | Uniform | 0.68 | 20 | 12 | 3 | 60% |
| Em18 (This Invention) | 4 | Uniform | 0.43 | 20 | 12 | 3 | 60% |
| Em19 (This Invention) | 4 | Uniform | 0.95 | 30 | 7 | 7 | 70% |
| Em20 (This Invention) | 4 | Uniform | 0.43 | 30 | 7 | 7 | 65% |

TABLE 6

Formula for the Multi-Layer Color Photosensitive Materials

| | |
|---|---|
| First Layer (Anti-halation Layer) | |
| Black colloidal silver | 0.2 |
| Gelatin | 1.3 |
| ExM-9 | 0.06 |
| UV-1 | 0.03 |
| UV-2 | 0.06 |
| UV-3 | 0.06 |
| Solv-1 | 0.15 |
| Solv-2 | 0.15 |
| Solv-3 | 0.05 |
| Second Layer (Intermediate Layer) | |
| Gelatin | 0.5 |
| Third Layer (Low Sensitive Red Sensitive Emulsion Layer) | |
| Silver iodobromide emulsion | 1.8 |
| Gelatin | 1.0 |
| ExS-1 | $4 \times 10^{-4}$ |
| ExS-2 | $5 \times 10^{-4}$ |
| ExC-1 | 0.05 |
| ExC-2 | 0.50 |
| ExC-3 | 0.03 |
| ExC-4 | 0.12 |
| ExC-5 | 0.01 |
| Fourth Layer (High Sensitive Red Sensitive Emulsion Layer) | |
| Silver iodobromide emulsion | 0.7 |
| Gelatin | 1.0 |
| ExS-1 | $3 \times 10^{-4}$ |
| ExS-2 | $2.3 \times 10^{-5}$ |
| ExC-6 | 0.11 |
| ExC-7 | 0.05 |
| ExC-4 | 0.05 |
| Solv-1 | 0.05 |
| Solv-3 | 0.05 |
| Fifth Layer (Intermediate layer) | |
| Gelatin | 0.5 |
| Cpd-1 | 0.1 |
| Solv-1 | 0.05 |
| Sixth Layer (Low Sensitive Green Sensitive Emulsion Layer) | |
| Silver iodobromide emulsion | 0.55 |
| Gelatin | 1.0 |
| ExS-3 | $5 \times 10^{-4}$ |
| ExS-4 | $3 \times 10^{-4}$ |
| ExS-5 | $1 \times 10^{-4}$ |
| ExM-8 | 0.4 |
| ExM-9 | 0.07 |
| ExM-10 | 0.02 |
| ExY-11 | 0.03 |
| Solv-1 | 0.3 |
| Solv-4 | 0.05 |
| Seventh Layer (High Sensitive Green Sensitive Emulsion layer) | |
| Silver iodobromide emulsion | 0.8 |
| ExS-3 | $5 \times 10^{-4}$ |
| ExS-4 | $3 \times 10^{-4}$ |
| ExS-5 | $1 \times 10^{-4}$ |
| ExM-8 | 0.1 |
| ExM-9 | 0.02 |
| ExY-11 | 0.03 |
| ExC-2 | 0.03 |

TABLE 6-continued

Formula for the Multi-Layer Color Photosensitive Materials

| | |
|---|---|
| ExM-14 | 0.01 |
| Solv-1 | 0.2 |
| Solv-4 | 0.01 |
| Eighth Layer (Intermediate Layer) | |
| Gelatin | 0.5 |
| Cpd-1 | 0.05 |
| Solv-1 | 0.02 |
| Ninth layer (Multi-Layer Effect Donor Layer) | |
| Silver iodobromide emulsion | 0.55 |
| Gelatin | 0.5 |
| ExS-3 | $8 \times 10^{-4}$ |
| ExY-13 | 0.11 |
| ExM-12 | 0.03 |
| ExM-14 | 0.10 |
| Solv-1 | 0.20 |
| Tenth Layer (Yellow Filter Layer) | |
| Yellow colloidal silver | 0.05 |
| Gelatin | 0.5 |
| Cpd-2 | 0.13 |
| Cpd-7 | 0.10 |
| Eleventh layer (Low Sensitive Blue Sensitive Emulsion Layer) | |
| Silver iodobromide emulsion | 0.45 |
| Gelatin | 1.6 |
| ExS-6 | $2 \times 10^{-4}$ |
| ExC-16 | 0.05 |
| ExC-2 | 0.10 |
| ExC-3 | 0.02 |
| ExY-13 | 0.07 |
| ExY-15 | 0.5 |
| ExY-17 | 1.0 |
| Solv-1 | 0.20 |
| Twelfth Layer (High Sensitive Blue Sensitive Emulsion Layer) | |
| Silver iodobromide emulsion | 0.5 |
| Gelatin | 0.5 |
| ExS-6 | $1 \times 10^{-4}$ |
| ExY-15 | 0.20 |
| ExY-13 | 0.01 |
| Solv-1 | 0.10 |
| Thirteenth layer (First Protective Layer) | |
| Gelatin | 0.8 |
| UV-4 | 0.1 |
| UV-5 | 0.15 |
| Solv-1 | 0.01 |
| Solv-2 | 0.01 |
| Fourteenth Layer (Second Protective Layer) | |
| Fine grained silver iodobromide emulsion (I 2 mol, Coefficient of vaiation (s/r) = 0.2, 0.07 μm) | 0.5 |
| Gelatin | 0.45 |
| Poly(methyl methacrylate) particles (diameter 1.5 μm) | 0.2 |
| H-1 | 0.4 |
| Cpd-3 | 0.5 |
| Cpd-4 | 0.5 |

These emulsions were chemically sensitized optimally in accordance with the illustrative examples in the respective patents (that is, JP-A-52-153428, JP-A 59-88639 and JP-A-58-113926) and then 9 samples as shown in Table 7 were prepared by introducing these emulsions into color photosensitive materials which had a multi-layer structure as indicated in Table 6.

The numerical values which indicate quantities in Table 6 are coated weight in units of g/m$^2$, the coated weight being shown after calculation as silver in the case of the silver halides. However, in the case of sensitizing dyes and couplers the amount coated is expressed in unirs of mols per mol of silver halide coated in the same layer.

TABLE 6

| Formula for the Multi-Layer Color Photosensitive Materials | |
|---|---|
| First Layer (Anti-halation Layer) | |
| Black colloidal silver | 0.2 |
| Gelatin | 1.3 |
| ExM-9 | 0.06 |
| UV-1 | 0.03 |
| UV-2 | 0.06 |
| UV-3 | 0.06 |
| Solv-1 | 0.15 |
| Solv-2 | 0.15 |
| Solv-3 | 0.05 |
| Second Layer (Intermediate Layer) | |
| Gelatin | 0.5 |
| Third Layer (Low Sensitive Red Sensitive Emulsion Layer) | |
| Silver iodobromide emulsion | 1.8 |
| Gelatin | 1.0 |
| ExS-1 | $4 \times 10^{-4}$ |
| ExS-2 | $5 \times 10^{-4}$ |
| ExC-1 | 0.05 |
| ExC-2 | 0.50 |
| ExC-3 | 0.03 |
| ExC-4 | 0.12 |
| ExC-5 | 0.01 |
| Fourth Layer (High Sensitive Red Sensitive Emulsion Layer) | |
| Silver iodobromide emulsion | 0.7 |
| Gelatin | 1.0 |
| ExS-1 | $3 \times 10^{-4}$ |
| ExS-2 | $2.3 \times 10^{-5}$ |
| ExC-6 | 0.11 |
| ExC-7 | 0.05 |
| ExC-4 | 0.05 |
| Solv-1 | 0.05 |
| Solv-3 | 0.05 |
| Fifth Layer (Intermediate layer) | |
| Gelatin | 0.5 |
| Cpd-1 | 0.1 |
| Solv-1 | 0.05 |
| Sixth Layer (Low Sensitive Green Sensitive Emulsion Layer) | |
| Silver iodobromide emulsion | 0.55 |
| Gelatin | 1.0 |
| ExS-3 | $5 \times 10^{-4}$ |
| ExS-4 | $3 \times 10^{-4}$ |
| ExS-5 | $1 \times 10^{-4}$ |
| ExM-8 | 0.4 |
| ExM-9 | 0.07 |
| ExM-10 | 0.02 |
| ExY-11 | 0.03 |
| Solv-1 | 0.3 |
| Solv-4 | 0.05 |
| Seventh Layer (High Sensitive Green Sensitive Emulsion layer) | |
| Silver iodobromide emulsion | 0.8 |
| ExS-3 | $5 \times 10^{-4}$ |

TABLE 6-continued

| Formula for the Multi-Layer Color Photosensitive Materials | |
|---|---|
| ExS-4 | $3 \times 10^{-4}$ |
| ExS-5 | $1 \times 10^{-4}$ |
| ExM-8 | 0.1 |
| ExM-9 | 0.02 |
| ExY-11 | 0.03 |
| ExC-2 | 0.03 |
| ExM-14 | 0.01 |
| Solv-1 | 0.2 |
| Solv-4 | 0.01 |
| Eighth Layer (Intermediate Layer) | |
| Gelatin | 0.5 |
| Cpd-1 | 0.05 |
| Solv-1 | 0.02 |
| Ninth layer (Multi-Layer Effect Donor Layer) | |
| Silver iodobromide emulsion | 0.55 |
| Gelatin | 0.5 |
| ExS-3 | $8 \times 10^{-4}$ |
| ExY-13 | 0.11 |
| ExM-12 | 0.03 |
| ExM-14 | 0.10 |
| Solv-1 | 0.20 |
| Tenth Layer (Yellow Filter Layer) | |
| Yellow colloidal silver | 0.05 |
| Gelatin | 0.5 |
| Cpd-2 | 0.13 |
| Cpd-7 | 0.10 |
| Eleventh layer (Low Sensitive Blue Sensitive Emulsion Layer) | |
| Silver iodobromide emulsion | 0.45 |
| Gelatin | 1.6 |
| ExS-6 | $2 \times 10^{-4}$ |
| ExC-16 | 0.05 |
| ExC-2 | 0.10 |
| ExC-3 | 0.02 |
| ExY-13 | 0.07 |
| ExY-15 | 0.5 |
| ExY-17 | 1.0 |
| Solv-1 | 0.20 |
| Twelfth Layer (High Sensitive Blue Sensitive Emulsion Layer) | |
| Silver iodobromide emulsion | 0.5 |
| Gelatin | 0.5 |
| ExS-6 | $1 \times 10^{-4}$ |
| ExY-15 | 0.20 |
| ExY-13 | 0.01 |
| Solv-1 | 0.10 |
| Thirteenth layer (First Protective Layer) | |
| Gelatin | 0.8 |
| UV-4 | 0.1 |
| UV-5 | 0.15 |
| Solv-1 | 0.01 |
| Solv-2 | 0.01 |
| Fourteenth Layer (Second Protective Layer) | |
| Fine grained silver iodobromide emulsion (I 2 mol, Coefficient of vaiation (s/r) = 0.2, 0.07 μm) | 0.5 |
| Gelatin | 0.45 |
| Poly(methyl methacrylate) particles (diameter 1.5 μm) | 0.2 |
| H-1 | 0.4 |
| Cpd-3 | 0.5 |
| Cpd-4 | 0.5 |

Moreover, the emulsion stabilizer Cpd-3 and the surfactant Cpd-4 as a coating promotor were added to each layer as well as the components indicated above. Compounds Cpd-5 and Cpd-6 below were alos added to each layer.

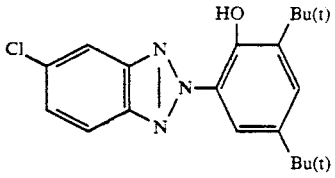
UV-1
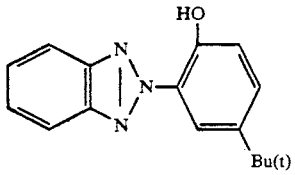
UV-2
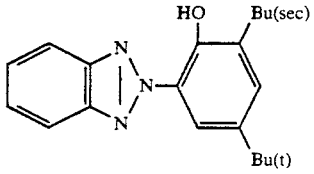
UV-3
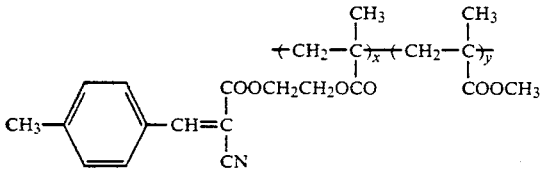
x/y = 7/3 (by weight)
UV-4
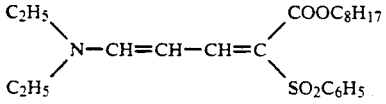
UV-5
Tricresyl phosphate — Solv-1
Dibutyl phthalate — Solv-2
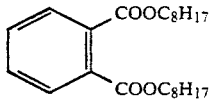
Solv-3
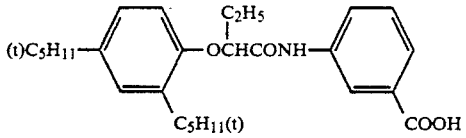
Solv-4
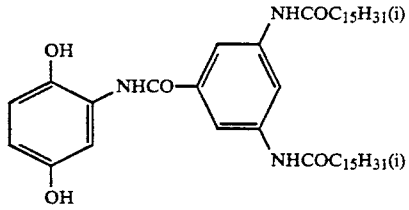
Cpd-1
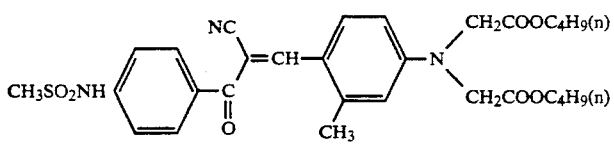
Cpd-2

-continued
Cpd-3
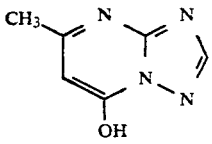
Cpd-4
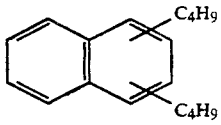
Cpd-5
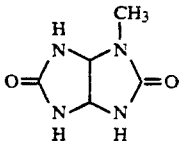
Cpd-6
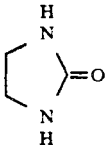
Cpd-7
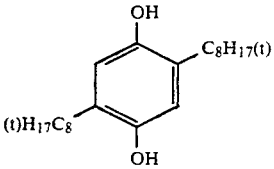
ExC-1
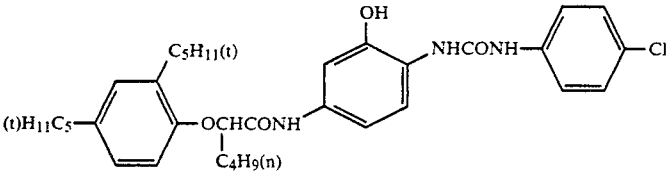
ExC-2
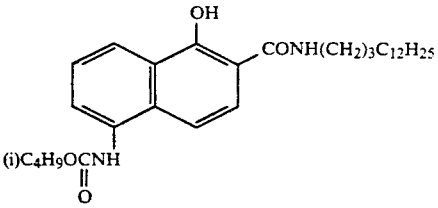
ExC-3
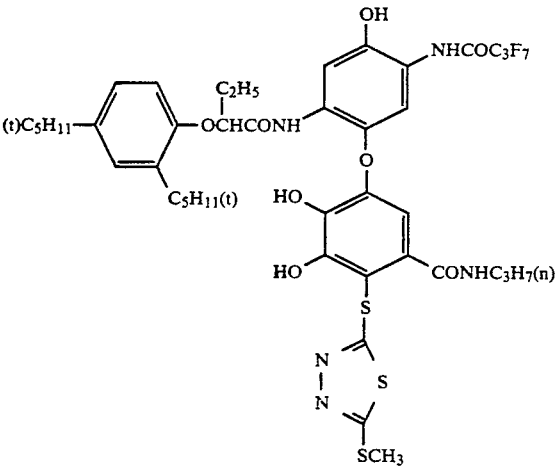

-continued
ExC-4
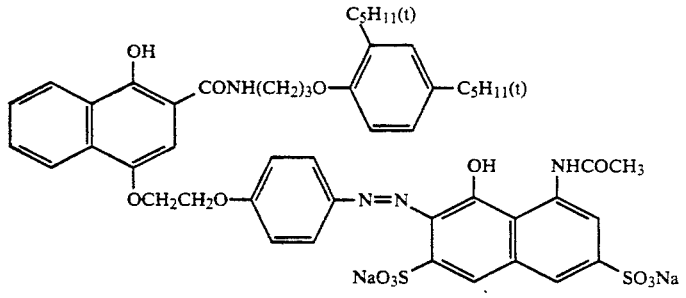
ExC-5
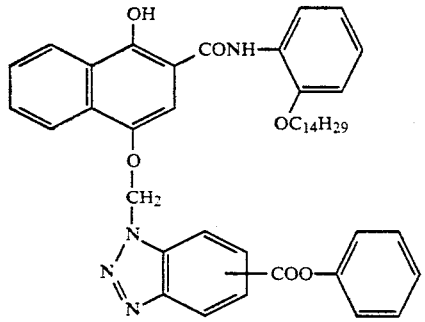
ExC-6
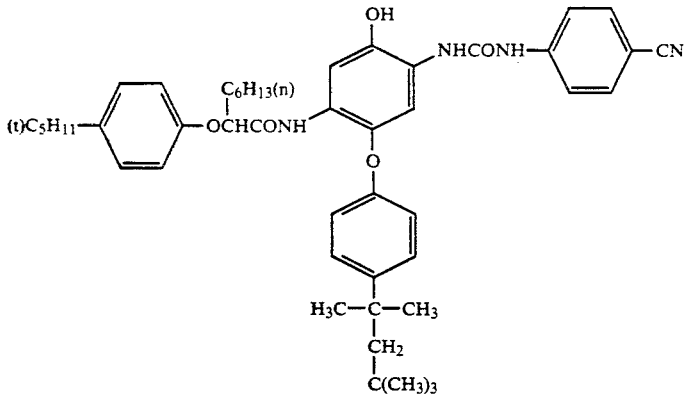
ExC-7
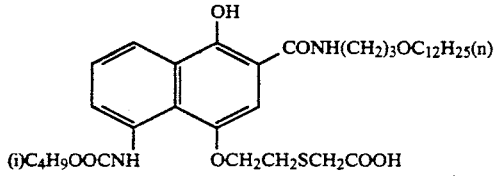

-continued
ExM-8
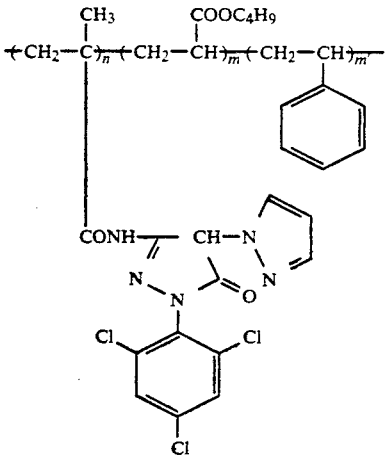
n:m:m' = 50:25:25 (by weight)
Average Molecular Weight about 20,000
ExM-9
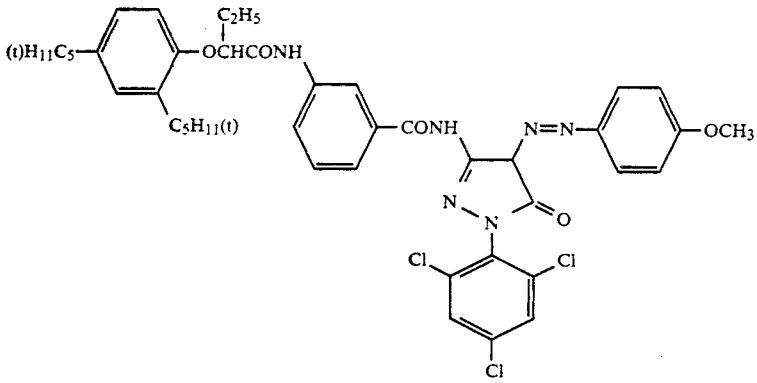
ExM-10
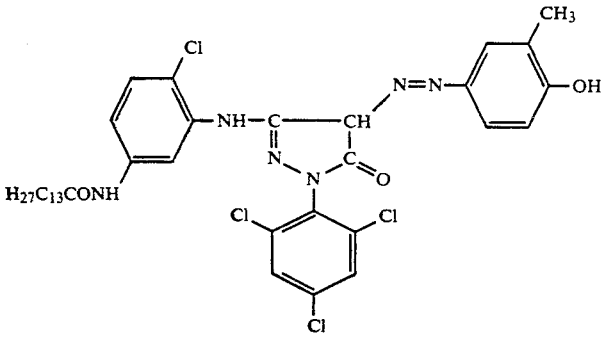
ExY-11
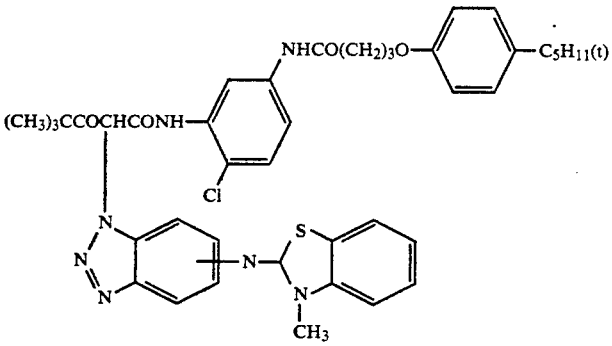

-continued
ExM-12
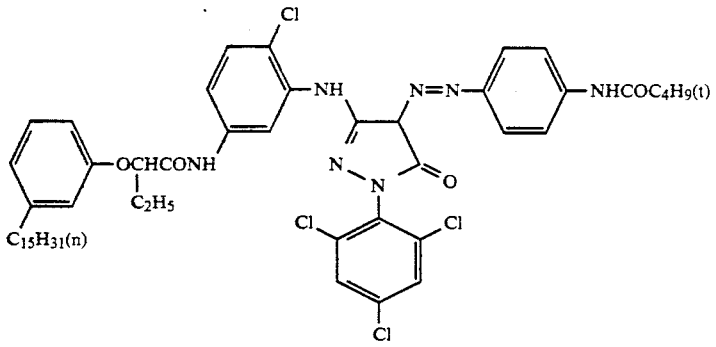
ExY-13
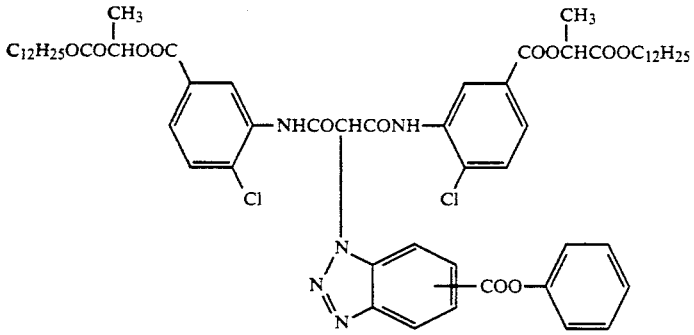
ExM-14
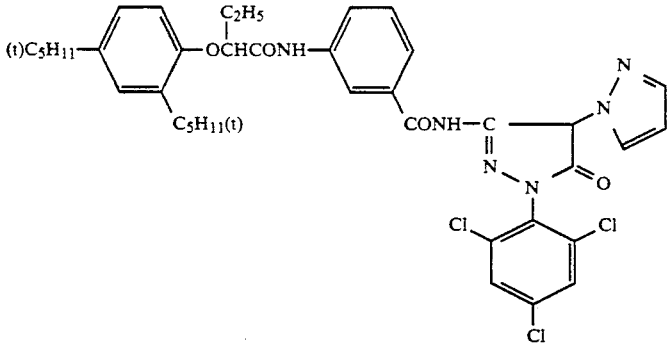
ExY-15
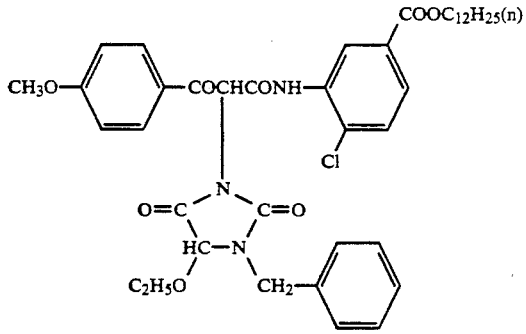

-continued
ExC-16
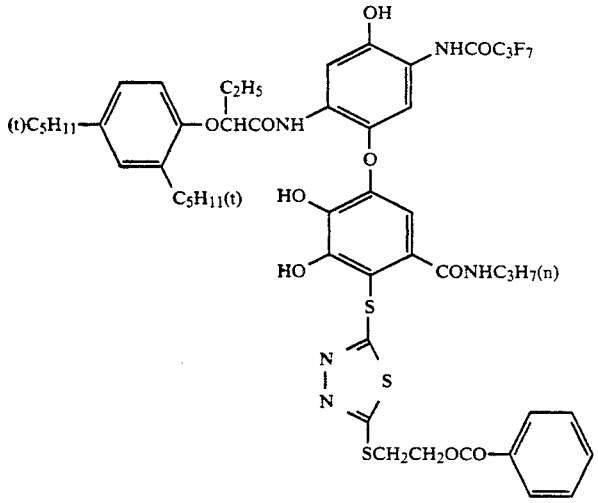
ExY-17
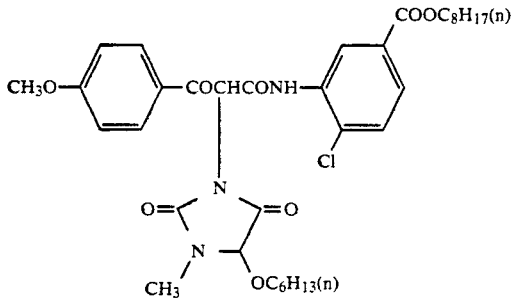
ExS-1
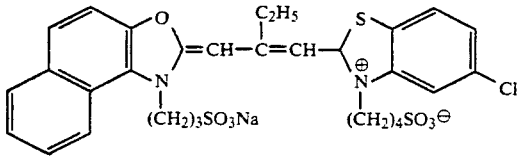
ExS-2
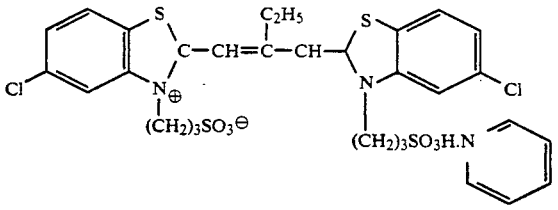
ExS-3
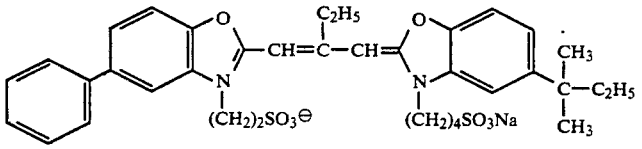
ExS-4
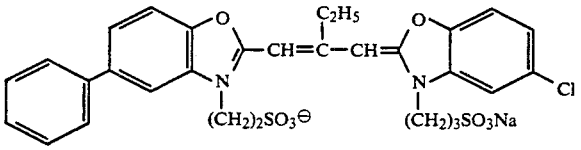

-continued

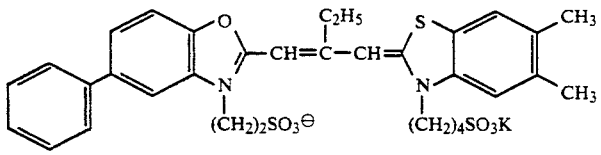

ExS-5

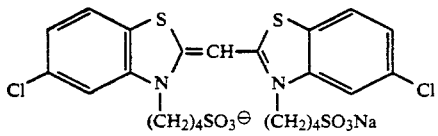

ExS-6

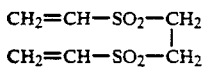

H-1

TABLE 7

Details of Samples 1 to 9 in Example 2

| Sample No. | Third Layer | Fourth Layer | Sixth Layer | Seventh Layer | Ninth Layer | Eleventh Layer | Twelfth Layer |
|---|---|---|---|---|---|---|---|
| 1 (Comp. Ex.) | Em1 (1.8 g/m²) | Em2 (0.7 g/m²) | Em1 (0.55 g/m²) | Em2 (0.8 g/m²) | Em3 (0.55 g/m²) | Em1 (0.45 g/m²) | Em4 (0.5 g/m²) |
| 2 (Comp. Ex.) | Em5 | Em6 | Em5 | Em6 | Em7 | Em1 | Em4 |
| 3 (Comp. Ex.) | Em13 | Em12 | Em13 | Em12 | Em11 | Em1 | Em4 |
| 4 (Comp. Ex.) | Em13 | Em12 | Em13 | Em12 | Em11 | Em10 | Em8 |
| 5 (Comp. Ex.) | Em13 | Em12 | Em13 | Em12 | Em11 | Em15 | Em14 |
| 6 (Comp. Ex.) | Em13 | Em12 | Em13 | Em12 | Em11 | Em15 | Em9 |
| 7 (Invention) | Em18 | Em17 | Em18 | Em17 | Em16 | Em10 | Em8 |
| 8 (Invention) | Em18 | Em17 | Em18 | Em17 | Em16 | Em20 | Em19 |
| 9 (Invention) | Em18 | Em17 | Em18 | Em17 | Em16 | Em20 | Em9 |

Samples 1 to 9 were exposed to white light through an appropriate wedge and developed and processed in the same way as in Example 1, and the characteristic curves obtained from measurements using R, G and B filters indicated similar sensitivities and gradations for Samples 1 to 9.

Graininess was evaluated using the RMS granularity. The RMS value was obtained by developing and processing in the same way as in Example 1 samples which had been subjected to uniform exposure to white light required to obtain a density of fog +0.2, and then making measurements using R, G and B filters in accordance with the method described in "The Theory of the Photographic Process", fourth edition, page 619, published by Macmillan.

Sharpness was evaluated by measuring the MTF. The method of measuring the MTF used was that described in the "Journal of Applied Photographic Engineering", volume 6 (1), pages 1–8 (1980). However, just the processing was carried out using the method used in Example 1. The MTF value was expressed as a relative value, taking the MTF value measured with the R filter for Sample 1 to be 100. The RMS granularities and MTF values of the samples obtained are shown in Table 8.

Pressure charaoteristics were evaluated using the ratio $\Delta fog/D_{max}$ obtained from values measured with B, G and R filters after subjecting the samples to the same flexing treatment as used in Example 1, exposing the flexed samples to white light appropriately, and developing and processing the exposed samples in the same way as in Example 1. The RMS granularities, sharpnesses (MTF values), and pressure characteristics measured with B, G and R filters for Samples 1 to 9 are shown in Table 8.

TABLE 8

Photographic Properties of Samples 1 to 9 in Example 2

| Sample No. | RMS Granularity | | | Sharpness (MTF Value) | | | Pressure Characteristics ($\Delta Fog/D_{max}$) (%) | | |
|---|---|---|---|---|---|---|---|---|---|
| | R | G | B | R | G | B | R | G | B |
| 1 (Comp. Ex.) | 0.033 | 0.030 | 0.040 | 100 | 110 | 110 | 10 | 10 | 10 |
| 2 (Comp. Ex.) | 0.031 | 0.028 | 0.040 | 105 | 114 | 113 | 10 | 9 | 10 |
| 3 (Comp. Ex.) | 0.029 | 0.026 | 0.039 | 108 | 117 | 116 | 15 | 15 | 10 |
| 4 (Comp. Ex.) | 0.029 | 0.026 | 0.042 | 110 | 119 | 117 | 15 | 15 | 16 |
| 5 (Comp. Ex.) | 0.029 | 0.026 | 0.039 | 109 | 119 | 117 | 15 | 15 | 14 |
| 6 (Comp. Ex.) | 0.029 | 0.026 | 0.040 | 111 | 121 | 118 | 15 | 15 | 15 |
| 7 (Invention) | 0.028 | 0.025 | 0.042 | 110 | 119 | 117 | 4 | 4 | 16 |
| 8 (Invention) | 0.028 | 0.025 | 0.039 | 110 | 119 | 117 | 4 | 4 | 6 |
| 9 (Invention) | 0.028 | 0.025 | 0.040 | 111 | 121 | 118 | 4 | 4 | 8 |

From a comparison of Samples 1 to 6, it is clear that granularity and sharpness are improved when tabular grains of low aspect ratio are included in the green sensitive and red sensitive emulsion layers, but there is an increase in pressure fogging. When emulsions of this invention were substituted for the green and red sensitive emulsion layers there was still an improvement in granularity and sharpness, and there was also a clear improvement in respect of pressure fogging on comparing Samples 1 to 6 against Samples 7 to 9. Further, from a comparison of Samples 8 and 9, it is clear that sharpness was still more improved when the emulsion of this invention was included in a silver halide emulsion layer other than a silver halide emulsion layer located furthest from a support.

While the invention has been described in detail and with reference to specific embodiments thereof, it will be apparent to one skilled in the art that various changes and modifications can be made therein without departing from the spirit and scope thereof.

What is claimed is:

1. A photosensitive silver halide emulsion comprising photosensitive silver halide grains dispersed in a binder, wherein at least 70% of the total projected area of silver halide grains comprises tabular grains having a diameter of at least 0.15 μm and wherein said grains comprise a core, an internal high iodide phase non-uniformly deposited on said core, and a phase which has a lower iodide content than the high iodide phase as a surface layer, wherein the iodide content of the core is lower than that of the high iodide pohase and is from 0 to 12 mol %, the internal high iodide phase is deposited in localized areas, is a silver halide solid solution and contains from 10 to 40 mol % iodide, and the high iodide phase surface layer has an iodide content of from 0 to 12 mol %, wherein the mean aspect ratio of said tabular grains is not more than 8.0, wherein grains, in which the value of the ratio (b/a) of the longest distance (a) between two or more parallel twinning planes in the tabular grain and the grain thickness (b) is at least 5, comprise at least 50% (in erms of numbers of grains) of all of said tabular grains, and wherein at least 50% (in erms of teh numbers of grains) of said tabular grains are grains in which the number of dislocations per grain is at least 10.

2. A photosensitive silver halide emulsion as in claim 1, wherien tabular grains of which the diameter is 0.15 μm or above comprise at least 80% of the total projected area of the sivler halide grains.

3. A photosensitive silver halide emulsion as in claim 1, wherein the diameter of the tabular grains is from 0.15 to 5.0 μm.

4. A photosensitive silver halide emulsion as in claim 1, wherein the thickness of the tabular grains is from 0.05 to 1.0 μm.

5. A photosensitive silver halide emulsion as in claim 1, wherein tabular grains of which the value of (b/a) is at least 5 comprise at least 70%, of the total number of tabular grains.

6. A photosensitive silver halide emulsion as in claim 1, wherein tabular grains of which the value of (b/a) is at least 10 comprise at least 50%., of the total number of tabular grains.

7. A photosensitive silver halide emulsion as in claim 1, wherein the mean aspect ratio of the silver halide emulsions is within the range from 2.0 to 5.0.

8. A photosensitive silver halide emulsion as in claim 1, wherein the location at which the dislocations of the tabular grains are formed, in the direction of the long axis of the tabular grains, is from a distance of 10% to 100% of the length from the center to the edge up to the edge.

9. A photosensitive silver halide emulsion as in claim 1, wherein the location at which the dislocations of the tabular grains are formed, in the direction of the long axis of the tabular grains, is from a distance of 50% to 95% of the length from the center to the edge up to the edge.

10. A photosensitive silver halide emulsion as in claim 1, wherein the number of grains which contain at least 20 dislocations is at least 80% (by number) of the grains which are present.

11. A photosensitive silver halide emulsion as in claim 1, wherein the internal high iodide phase comprise from 5 to 80 mol. % of the total silver content of the grains.

12. A color photosensitive material comprising at least one blue sensitive silver halide emulsion layer, at least one green sensitive silver halide emulsion layer, and at least one red sensitive silver halide emulsion layer, provided on a support, wherein a photosensitive silver halide emulsion wherein at least 70% of the total projected area of silver halide grains comprise tabular grains having a diameter of at least 0.15 μm and wherein said grains comprise a core, an internal high iodide phase non-uniformly deposited on said core, and a phase which has a lower iodide content than the high iodide phase as a surface layer, wherein the iodide content of the core is lower than that of the high iodide phase and is from 0 to 12 mol %, the internal high iodide phase is deposited in localized areas, is a silver halide solid solution and contains from 10 to 40 mol % iodide, and the high iodide phase surface layer has an iodide content of from 0 to 12 mol %, wherein the mean aspect ratio of said tabular grains is not more than 8.0, wherein grains, in which the value of the ratio (b/a) of the longest distance (a) between two or more parallel twinning planes in the tabular grain and the grain thickness (b) is at least 5, comprise at least 50% (in terms of numbers of grains) of all of said tabular grains, and wherein at least 50% (in terms of numbers of grains) of said tabular grains are grains in which the number of dislocations per grain is at least 10 is present in at least one silver halide emulsion layer other than a silver halide emulsion layer which is located farthest from the support.

* * * * *